US010654073B2

(12) United States Patent
Pomerleau

(10) Patent No.: US 10,654,073 B2
(45) **Date of Patent: *May 19, 2020**

(54) DUAL SCREEN ASSEMBLY FOR VIBRATING SCREENING MACHINE

(71) Applicant: FP Canmechanica Inc, Calgary, Alberta (CA)

(72) Inventor: Daniel Guy Pomerleau, Calgary (CA)

(73) Assignee: FP Canmechanica Inc., Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/390,467

(22) Filed: Apr. 22, 2019

(65) Prior Publication Data

US 2019/0240700 A1 Aug. 8, 2019

Related U.S. Application Data

(60) Continuation of application No. 15/876,513, filed on Jan. 22, 2018, now Pat. No. 10,265,731, which is a division of application No. 14/915,130, filed as application No. PCT/CA2014/000655 on Aug. 26, 2014, now Pat. No. 9,908,149.

(60) Provisional application No. 62/008,868, filed on Jun. 6, 2014, provisional application No. 61/936,119, filed on Feb. 5, 2014, provisional application No. 61/870,687, filed on Aug. 27, 2013.

(51) Int. Cl.
*B07B 1/46* (2006.01)
*B07B 1/48* (2006.01)

(52) U.S. Cl.
CPC ..... *B07B 1/46* (2013.01); *B07B 1/48* (2013.01); *B07B 2201/02* (2013.01); *B07B 2201/04* (2013.01)

(58) Field of Classification Search
CPC ..... B07B 1/46; B07B 1/48; B07B 2201/02; B07B 2201/04
USPC ..... 209/319
See application file for complete search history.

(56) References Cited

U.S. PATENT DOCUMENTS 1,431,987 A 10/1922 Simpson
2,274,700 A 3/1942 Jenks
(Continued)

FOREIGN PATENT DOCUMENTS

DE 3606854 A1 9/1987
WO 2010048718 A1 5/2010
(Continued)

OTHER PUBLICATIONS

PCT International Search Report and Written Opinion, Application No. PCT/CA2014/000655, dated Nov. 6, 2014, 6 pgs.
(Continued)

*Primary Examiner* — Terrell H Matthews
(74) *Attorney, Agent, or Firm* — Patent Law Works LLP

(57) ABSTRACT

A screen system for improving a vibrating shaker apparatus for separating drilling fluid and drill cuttings is described. The screen system comprises a dual screen having a coarse mesh upper screen attached to a finer mesh lower screen with a channel between the two screens. One or both of the screens may be wedge shaped to affect the flow rate of drilling fluid and drill cuttings across the screen. The screen systems can be installed in existing shaker apparatuses using various attachment systems, such as wedge clamping systems, hydraulic or air pressure clamping systems, or hook screen systems.

5 Claims, 22 Drawing Sheets

(56) References Cited

U.S. PATENT DOCUMENTS

| | | | | |
|---|---|---|---|---|
| 4,319,993 | A | 3/1982 | Krause | |
| 4,498,981 | A * | 2/1985 | Frevert | B07B 1/46 209/243 |
| 4,848,607 | A | 7/1989 | Halley | |
| 4,861,463 | A | 8/1989 | Slesarenko | |
| 6,032,806 | A | 3/2000 | Leone et al. | |
| 6,179,128 | B1 | 1/2001 | Seyffert | |
| 6,186,337 | B1 | 2/2001 | Adams et al. | |
| 6,431,366 | B2 | 8/2002 | Fallon | |
| 6,446,813 | B1 | 9/2002 | White | |
| 6,868,972 | B2 | 3/2005 | Seyffert et al. | |
| 8,002,116 | B1 | 8/2011 | Cato | |
| 8,556,083 | B2 | 10/2013 | Burnett | |
| 10,265,731 | B2 * | 4/2019 | Pomerleau | B07B 1/48 |
| 2004/0099578 | A1 | 5/2004 | Winkler et al. | |
| 2010/0270216 | A1 | 10/2010 | Burnett et al. | |
| 2011/0198269 | A1 * | 8/2011 | Young | B07B 1/46 209/365.1 |
| 2014/0166546 | A1 | 6/2014 | Kinnunen | |
| 2016/0207069 | A1 | 7/2016 | Pomerleau | |
| 2016/0319616 | A1 * | 11/2016 | Babri | E21B 21/066 |

FOREIGN PATENT DOCUMENTS

| | | | |
|---|---|---|---|
| WO | 2011113132 | A1 | 9/2011 |
| WO | 2011140635 | A2 | 11/2011 |
| WO | 2014065670 | A1 | 5/2014 |
| WO | 2015027321 | A1 | 3/2015 |

OTHER PUBLICATIONS

PCT International Preliminary Report on Patentability, PCT/CA2014/000655, dated Mar. 1, 2016, 4 pages.

Australian Examination Report, Application No. 2019200761, Australian Govemment IP Australia, dated Oct. 11, 2019, 5 pages.

* cited by examiner

DUAL SCREEN ASSEMBLY FOR VIBRATING SCREENING MACHINE

CROSS-REFERENCE TO RELATED APPLICATIONS

This application is a continuation of U.S. patent application Ser. No. 15/876,513, filed Jan. 22, 2018, pending, which is a divisional of U.S. patent application Ser. No. 14/915,130, filed Feb. 26, 2016, issued, which is a national phase entry under 35 U.S.C. § 371 of International Patent Application PCT/CA2014/000655, filed Aug. 26, 2014, designating the United States of America and published in English as International Patent Publication WO 2015/027321 A1 on Mar. 5, 2015, which claims the benefit under Article 8 of the Patent Cooperation Treaty and under 35 U.S.C. § 119(e) to U.S. Provisional Patent Application Ser. No. 62/008,868, filed Jun. 6, 2014, to U.S. Provisional Patent Application Ser. No. 61/936,119, filed Feb. 5, 2014, and to U.S. Provisional Patent Application Ser. No. 61/870,687, filed Aug. 27, 2013, the disclosure of each of which is hereby incorporated herein in its entirety by this reference.

FIELD OF THE INVENTION

The invention relates to improvements in vibrating screen systems for the separation of solids and fluids and particularly for the separation of drill cuttings from drilling fluid. In various embodiments, dual screen systems for retro-fit attachment to existing single-deck vibratory shakers are described.

BACKGROUND OF THE INVENTION

Screening machines have been used in various industries including the mining and oil industries for many years to enhance the separation of solids and liquids. Within these industries, drilling and mineral extraction processes often produce slurries of solids and liquids that must be separated from one another. As is well known, a screening machine typically includes a screen bed over which a solution containing fluids and solids is passed and then subjected to various separation forces including gravity and shaking. Each screen separation apparatus will utilize different types and sizes of screens to enable separation of different fluids/solids. In addition, the use of vacuum systems to improve separation within screening systems has also been implemented including the use of pulsed vacuum pressure as described in the inventor's co-pending and issued patent applications.

Depending on the industry, the fluid/solid solutions being screened and the commercial objectives of the screening systems, different designs of screening machines exist. In different machines, certain functions have been incorporated into each machine for use within a specific industry or with specific solid/liquid solutions. The nuances of each general type of solid/liquid solution and each machine generally means that one type of machine will not be operative or effective within a different industry as, in many cases, unique problems exist in the handling of specific types of materials or solutions. For example, many screening machine designs have been designed to optimize recovery of the solid materials from within a slurry; however, this format tends to ignore the quality of the recovered fluid. As such, it has generally not been considered how to effect separation of solids and liquids while maintaining or improving the quality of the fluid being recovered.

In the specific case of separating drilling fluid from drill cuttings at a well site, vacuum systems for the separation of drilling fluid from drill cuttings have been effectively deployed in the field in recent years by the applicant. As described in the inventor's co-pending applications and incorporated herein by reference (PCT/CA2009/001555 filed Oct. 29, 2009, PCT/CA2010/00501 filed Mar. 31, 2010, and PCT/CA2011/000542 filed May 11, 2011) the use of a vacuum force on a shaker system, when applied correctly, can be highly effective in reducing drilling fluid retained on cuttings for increasing the quantity of recovered drilling fluid, while also minimizing damage to drill cuttings which can result in contamination of the drilling fluid with fine solid materials that can pass through the screens for increasing the quality of recovered drilling fluid.

Furthermore, the efficiency of shaker systems is important to minimize the costs of solids control processing at a well. For example, at most drilling rigs, multiple shaker systems are installed to simultaneously process drill cuttings from the rig. As is common practice, typically two or more shakers (often 3 or more and potentially up to 9 shakers) are configured to the drilling rig adjacent the blowout preventer (BOP). As drilling fluids and drill cuttings exit the well head, they are conveyed to the shakers via conduits to the possum belly of each the shakers. The conveyed cuttings and drilling fluids are generally split into separate flow streams at the well head in order that a relatively consistent amount of cuttings/fluid is delivered to each shaker.

As can be appreciated, the total number of shakers that may be utilized at a drill site will significantly influence the total costs of the solids handling program. That is, to the extent that fewer shakers are required, the costs of solids handling can be reduced.

In addition, in a typical scenario, shaker systems may be configured in series to one another wherein an upstream shaker may utilize a coarse screen and a downstream shaker may utilize a finer screen. As is understood, the coarse screen will enable relatively finer solids and drilling fluid to pass through the screen and a finer screen will allow drilling fluid to pass through the screen while retaining the finer solids on the upper surface of the screen.

Generally, a balance must be maintained between the pore size of the screen and the desired processing rate. For example, in order to maintain an effective flow rate over a shaker, a combination of coarse and fine screens is usually used such that sufficient volumes of fluid are recovered within a particular time period. That is, if too fine of a screen is used, the time required to process a volume of drill cuttings and drill fluid becomes inefficient, and/or separation of drill cuttings and drill fluid may be prevented due to screen clogging and/or blinding. However, if too coarse a screen is used, the fluid/solids separation becomes inefficient in that the quality of recovered drilling fluid is reduced by solid contaminants.

In the past, various screens and shaker systems have been designed to improve the separation efficiencies including 3-dimensional screen designs and shaker systems. For example, U.S. Pat. No. 6,032,806 describes a "pyramid" style shaker screen in which a three-dimensional screen is used to increase the surface area of the screen. In other systems, shaker systems have been designed to include separate decks for separating solids at different vertical positions within a shaker. However, these past systems remain inefficient in a number of aspects. For example, double deck shakers are more expensive to build in that separate deck and attachment systems, such as clamps, wedges or hooks, are required for each level of deck. In addition, these systems are often significantly taller than a conventional single level shaker.

There are several different attachment systems that are commonly used to secure a screen system to a shaker, specifically within the shaker basket. One such attachment system is a wedge system. The wedge system typically comprises compressing wedges that are located on the sides of the shaker basket, each wedge being driven into a guide located above the position where the screen is located to secure the screen in place in the basket. A compressing wedge is typically about 1 inch wide and 12-18 inches long, and two wedges are typically used per screen.

An alternative attachment system is a plate clamping system, which generally comprises plates or rails located on the sides of the shaker basket that are squeezed together using air or hydraulic pressure to clamp the edge of the screen between the plates/rails. The plates or rails are typically about 1 to 1½" wide.

A third type of attachment system is a hook screen system that pulls the edges of the screen toward the sides of the shaker basket to apply tension to the screen. This is generally done by using a lever that can attach to the side of the screen with a hook. A force is applied to the lever, pulling the lever through a hole located in the side of the shaker basket, thereby pulling the screen outwards to apply tension to the screen. Typically the force applied to the lever is a spring force, however in some designs the spring is replaced with a bolt and screw arrangement which is adjusted to a predetermined torque, or with an air or hydraulic piston assembly. With the hook screen attachment system, the screen may be pulled over a flat surface or a curved surface, such as a convex surface. Pyramidal style shaker screens are often attached to shakers using a hook screen attachment. An example of a hook screen attachment system is described in U.S. Pat. No. 6,179,128.

A problem with prior art shakers is the effect of both large and small particles on a screen. That is, larger particles have the tendency to impact a screen with greater force due to the momentum of the particle. Fine screens, with narrower and less strong wires may be degraded more rapidly as a result of impact with larger particles. Thus, a layered screen system with a coarser upper screen and a finer lower screen has the advantage of protecting the lower screen from larger and potentially damaging particles as these particles will be carried on the upper screen and will not transit through the coarse screen to impact the fine screen below.

Another issue is that it is important to ensure that a layered screen system won't be compromised by the flow of drill cuttings and drilling fluid over the shaker such that the performance of the screens/shaker is affected. In particular, it is important that the gap between a lower screen and upper screen does not become clogged if the flow of drilling fluid/drill cuttings through the gap becomes high due to the volume of material in the shaker.

As a result, there continues to be a need for systems that improve the effectiveness of shaker systems to enable the sequential separation of coarser and fine solids. In addition, there is also a need for systems that can be retrofit to existing shaker systems, including existing shaker system attachment systems, to effectively turn single deck systems into double-deck screening systems.

SUMMARY OF THE INVENTION

In accordance with the invention, there is provided a dual screen system for retrofit connection to a vibratory shaker.

In one embodiment of the invention, the dual screen system comprises an upper screen assembly in operative connection with a lower screen assembly defining a channel between the upper screen and lower screen assemblies, each screen assembly having a frame and a screen mesh attached to the frame and wherein the upper screen assembly has a coarser screen mesh than the lower screen and the dual screen system is adapted for operative connection to the vibratory shaker.

In a further embodiment, the upper screen assembly is detachable from the lower screen assembly. The upper screen frame may include a plurality of leg members for attaching to a plurality of corresponding leg members on the lower screen frame, and the plurality of leg members on the upper and lower screen frames may snap together.

In another embodiment, the dual screen system further comprises a separate connector assembly located between the upper and lower screen assemblies for connecting the upper screen frame to the lower screen assembly frame, the connector assembly defining the channel. In one embodiment, the connector assembly comprises a frame supported by a plurality of legs, the frame for operative connection to the upper and lower screen frames. The connector assembly may further comprise a first plurality of pins protruding from the top of the frame for insertion into holes in the bottom of the upper screen frame; and a second plurality of pins protruding from the bottom of the legs for insertion into holes in the top of the bottom screen frame.

In yet another embodiment, the connector assembly comprises a plurality of bars running parallel with the upper and lower screen assembly frames. The plurality of bars may have a first plurality of pins protruding from the top of the bars for insertion into holes in the bottom of the upper screen frame; and a second plurality of pins protruding from the bottom of the bars for insertion into holes in the top of the bottom screen frame. In another embodiment, to ensure that the upper and lower screen assemblies do not slide, rubber gaskets and/or high pressure clamping systems may be used.

In one embodiment, the side edges of the upper screen frame are inset with respect to the side edges of the lower screen frame. In a further embodiment, the upper screen frame includes a lip that extends over one end of the dual screen system for directing flow over the end of the dual screen assembly.

In another embodiment, the upper and/or lower screen frames are wedge-shaped. The channel defined by the wedge-shaped frames may have a substantially constant height.

In a further embodiment, a plurality of dual screen systems are positioned in a vibratory shaker to define a continuous flow path through the channels of the plurality of dual screen systems from an upstream end to a downstream end. The plurality of dual screen systems may be positioned in a stepped-manner in the vibratory shaker, with the upstream end of the upper screen assemblies inset with respect to the upstream end of the lower screen assemblies for enlarging the flow path between adjacent lower screen assemblies.

In one embodiment, where the upper and/or lower screen frames are wedge-shaped, they may be positioned in a stepped-manner in the vibratory shaker to define a continuous flow path through the channels. The continuous flow path may be a cascading flow path.

In yet another embodiment, the upper screen mesh has a mesh size of 325 mesh or less and the lower screen mesh has a mesh size of greater than 30 mesh.

In a further embodiment, the channel has a height of 3 inches or less, and preferably 2 inches or less.

In one embodiment, the dual screen system is for retrofit connection to a shaker having a pre-existing flat screen bed, wherein the plurality of dual screen systems have height dimensions to create a cascading effect between dual screen systems.

In another embodiment of the invention, the dual screen system is configured to be secured in a shaker bed of the vibratory shaker using an existing wedge clamping attachment system in the shaker bed. The dual screen system may include an attachment arm at each side, the attachment arms for clamping with the wedges of the wedge clamping system. The dual screen system may be dimensioned such that the existing wedges of the wedge clamping attachment system can be used to secure the dual screen system in the shaker bed without modifying the wedge clamping system. The width of at least one of the upper or lower screen assemblies is narrower than the attachment arms.

In one embodiment of the invention, the dual screen system is configured to be secured in a shaker bed of the vibratory shaker using an existing hydraulic or air pressure clamping attachment system in the shaker bed.

In another embodiment, the dual screen system is configured to be secured in a shaker bed of the vibratory shaker using an existing hook attachment system in the shaker bed. The hook attachment system may be modified to include an upper and lower hook, and the upper and lower screen assemblies each include a corresponding hook for attachment to the upper and lower hook, respectively. The upper and lower screen assemblies may be tensioned using one tensioning attachment device.

In a further embodiment, the upper and lower screens are pyramidal screens.

In another aspect, the invention provides a dual screen system for retro-fit connection to a shaker supporting at least two stepped screens on corresponding support brackets within a shaker basket, the dual screen system comprising: a lower screen support having dimensions to fit between and lower than the support brackets, the lower screen support for supporting a first lower screen; an upper screen support operatively connected to the lower screen support, the upper screen support having dimensions to fit over the support brackets, the upper screen support for supporting a first upper screen; wherein the lower screen support and upper screen support define a dual screen support pair and wherein the dual screen system includes a dual screen support pair for each step within the shaker.

In one embodiment, adjacent dual screen support pairs are attached together.

In another embodiment, screen surfaces are affixed to each of the lower screen support and upper screen support for each dual screen support pair.

In one embodiment, each screen surface includes a downstream lip having dimensions to overlap an upstream edge of an adjacent downstream screen.

In one embodiment, a coarse screen is attached to each upper screen support and a fine screen is attached to each lower screen support.

BRIEF DESCRIPTION OF THE DRAWINGS

The invention is described with reference to the accompanying figures in which.

DETAILED DESCRIPTION OF THE INVENTION

With reference to the figures, a dual screen system 10 for attachment to an existing vibratory shaker is described.

Dual Screen System

Referring to FIGS. 1-3C, the dual screen system 10 comprises an upper screen assembly 12 having a coarse mesh stacked on top of a lower screen assembly 14 having a fine mesh, wherein there is a channel 16 between the upper and lower screen. The dual screen system is retro-fit into an existing vibratory shaker, originally configured to receive only a single layer screen, having a shaker bed onto which the dual screen system 10 is attached via wedges, hydraulic clamps, or hook screen tensioning devices. A slurry of recovered drilling fluid and drill cuttings is delivered from a wellbore onto the upper screen, wherein large particles are retained on the coarse upper screen while smaller particles and drilling fluid flow into the channel 16 and onto the lower screen. The fine mesh of the lower screen further separates the slurry by retaining fine and medium particles on the lower screen, and the drilling fluid flows through the lower screen for recovery and re-use. In one embodiment, the mesh size of the upper screen is 200 mesh or less (typically around 38-200 mesh), while the lower screen is greater than 200 mesh. Preferably, the lower screen is 50 to 100 mesh finer than the upper screen and will typically be in the range of 200 to 325 to potentially as high as 400 mesh. Preferably, the coarser screen on the top is strategically selected to remove larger drill cuttings whose impact velocity, caused by the high acceleration forces of the shaker basket, may damage the wires typically used in finer (i.e. higher mesh number) screens. In other words, the objective is to remove as much coarse material as possible on the upper deck while permitting finer material to pass through the coarse screen to be recovered on the lower deck.

The channel 16 between the upper and lower screen is of sufficient height to accommodate the flow of drill cuttings through the upper screen and across the lower screen, but also kept to a minimum in order to create a dual screen system having low clearance in order to fit into an existing shaker designed to accommodate a single screen. In one embodiment, the channel 16 is approximately ½ to 2" in height. However, this can be greater if the manner in which the system is attached does not interfere with existing screen clamping systems.

Figure 2A:
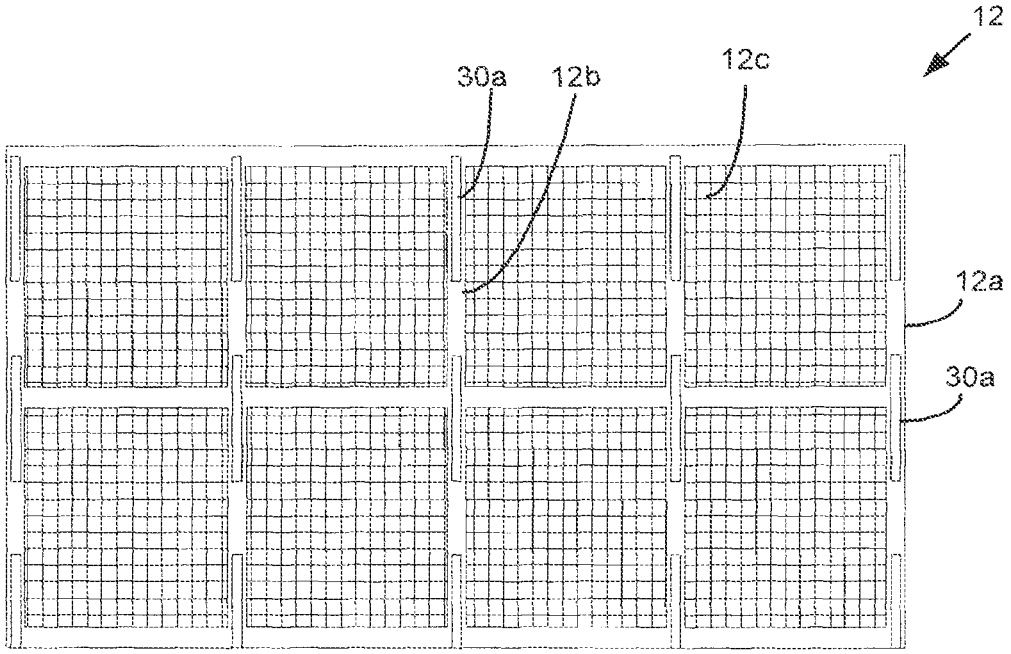
FIG. 2A is a top view of an upper screen assembly having connecting members with grooves in accordance with one embodiment of the invention.
Figure 2B:
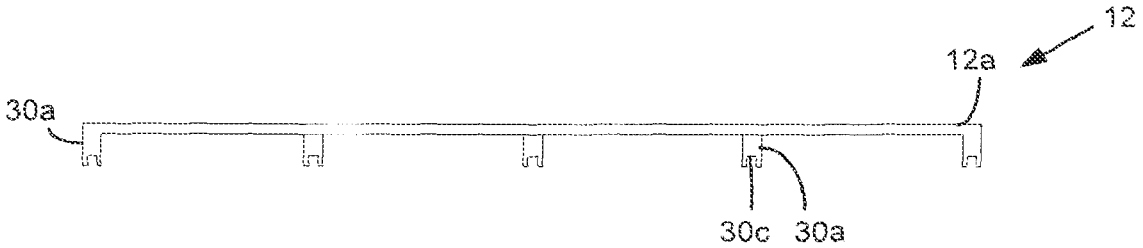
FIG. 2B is a front view of an upper screen assembly having connecting members with grooves in accordance with a first embodiment of the invention.
Figure 2C:
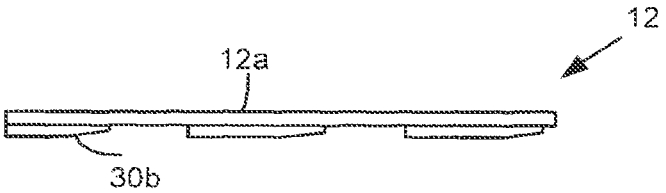
FIG. 2C is a side view of an upper screen assembly having connecting members with grooves in accordance with a first embodiment of the invention.
Figure 3A:
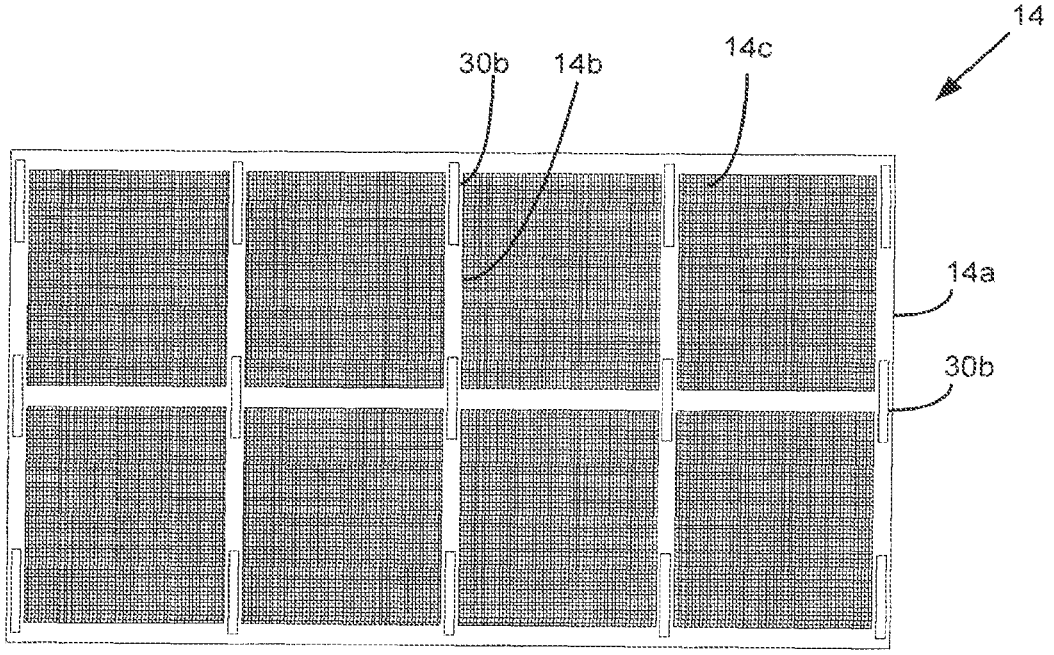
FIG. 3A is a top view of a lower screen assembly having connecting members in accordance with a first embodiment of the invention.
Figure 3B:
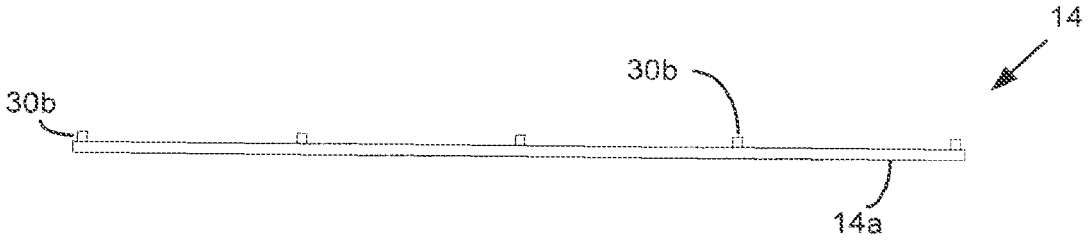
FIG. 3B is a front view of a lower screen assembly having connecting members in accordance with a first embodiment of the invention.
Figure 3C:
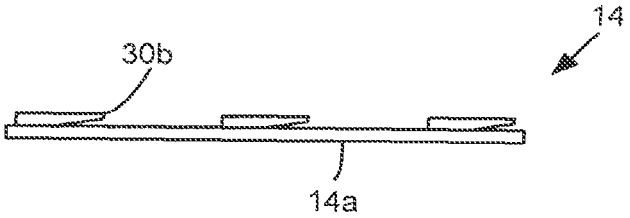
FIG. 3C is a side view of a lower screen assembly having connecting members in accordance with a first embodiment of the invention.
Figure 10:
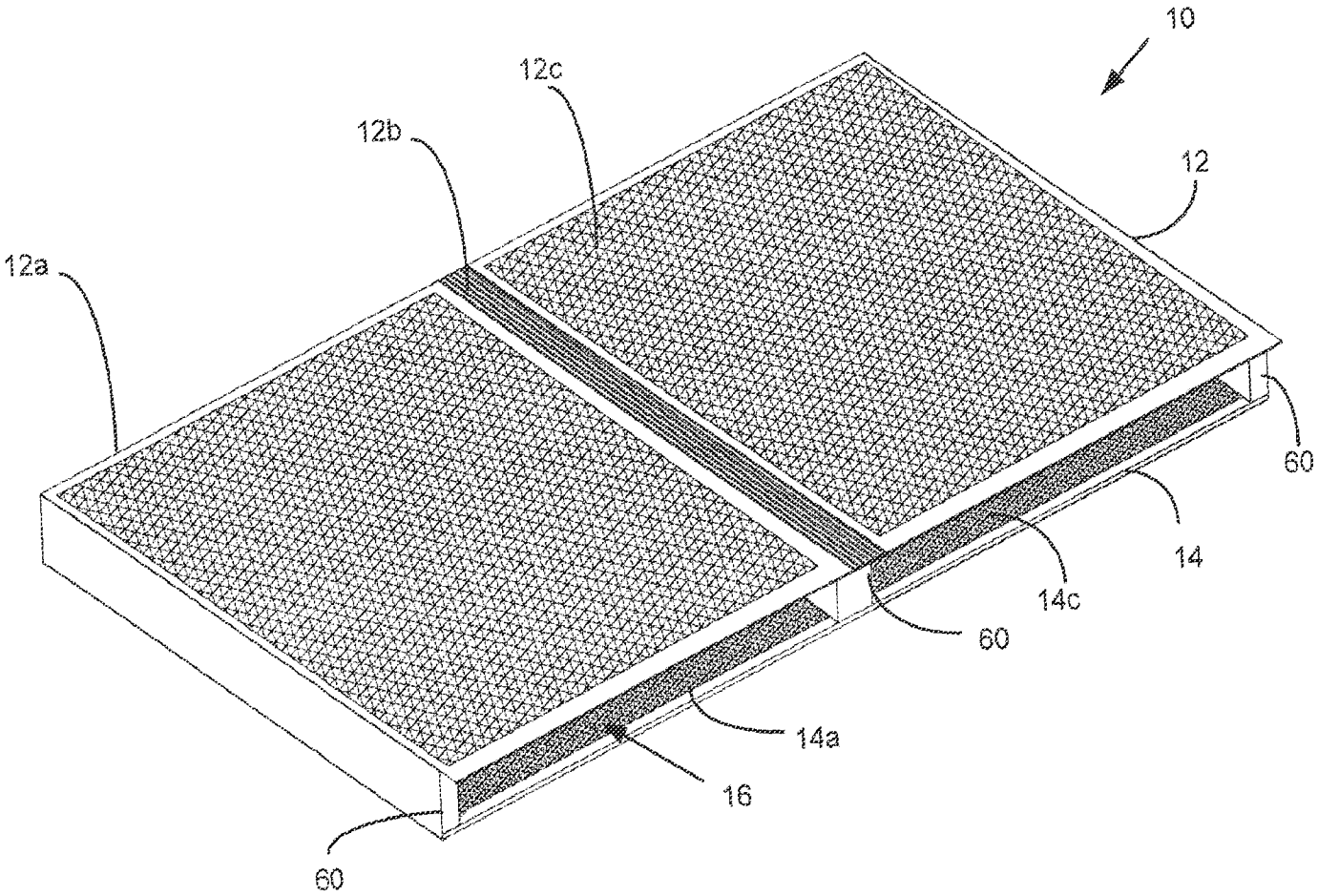
FIG. 10 is a front perspective view of a dual screen system in accordance with one embodiment of the invention.

Each screen assembly generally has a frame 12*a*, 14*a* having cross members 12*b*, 14*b*, and a screen mesh 12*c*, 14*c* that is supported on top the frame and cross members. FIGS. 2 and 3 show one lengthwise cross member and three widthwise cross members, however other configurations for cross members may be used to support the screen and may not be necessary depending on the size of the frame. FIG. 10 illustrates a dual screen system 10 having one cross member on each the upper and lower screen.

Connecting Members on Dual Screen System

Figure 1:
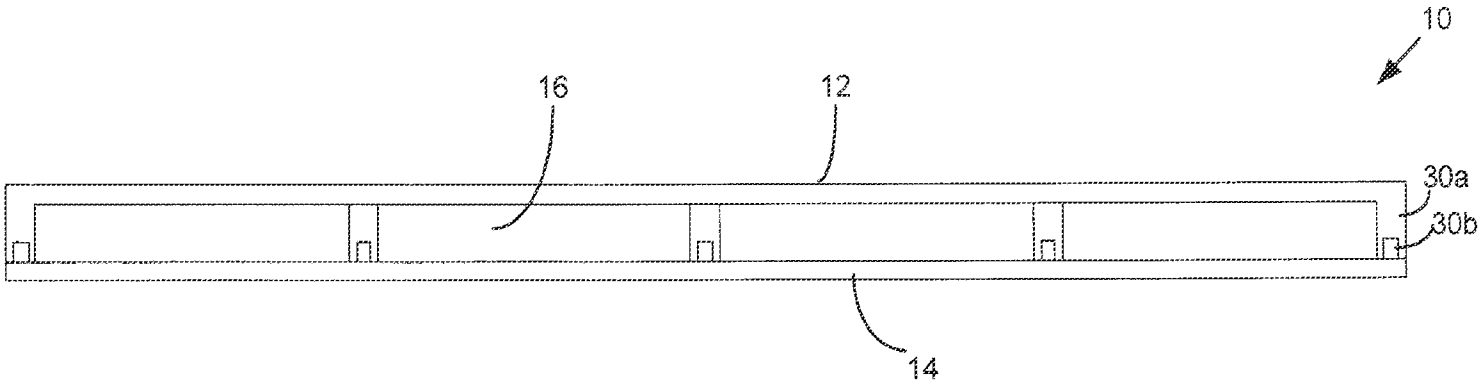
FIG. 1 is a front view of a dual screen system in accordance with one embodiment of the invention.
Figure 4:
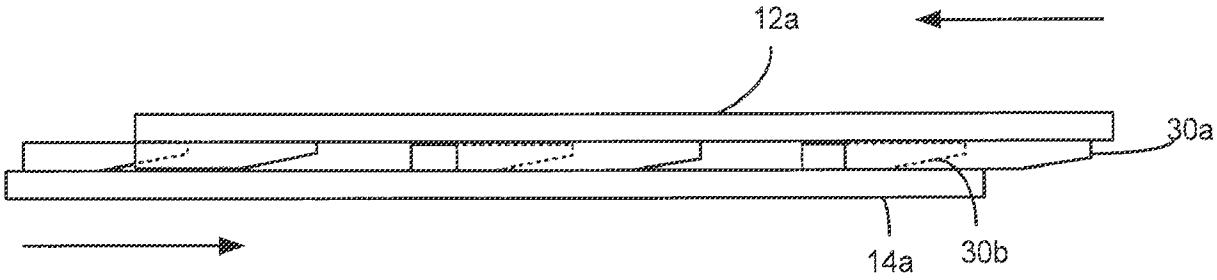
FIG. 4 is a side view of an upper and lower screen assembly being connecting by sliding the connecting members of the upper and lower screen assemblies together in accordance with a first embodiment of the invention.

The upper and lower screen assemblies may be made of a single structure or be two separate screen assemblies that operatively connect to one another. In one embodiment, shown in FIGS. 1-4, the upper and lower screen assemblies are snapped together using a plurality of connecting members 30*a*, 30*b* attached to the frame 12*a*, 14*a* and support members 12*b*, 14*b*. The upper screen connecting members 30*a* extend from the bottom of the upper screen frame and support members and each have a groove 30*c*. The lower screen connecting members 30*b* extend from the top of the lower screen frame and operatively engage with the groove 30*c* of the upper screen connecting members. FIG. 4 illustrates how the upper and lower screen connecting members are joined, by sliding the connecting members towards one another such that the lower screen connecting members engage with the corresponding grooves on the upper screen frame.

Central Separator Connecting System for Dual Screen

Figure 5A:
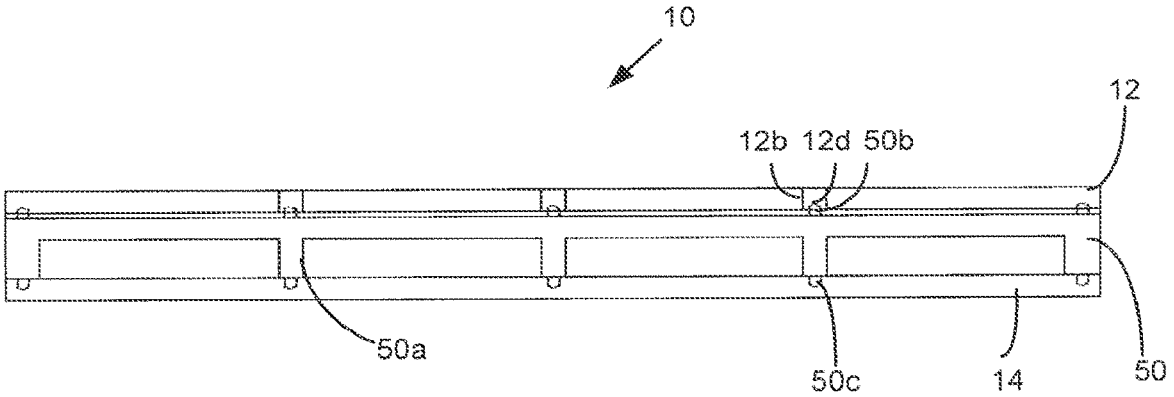
FIG. 5A is a front view of a dual screen system having an upper screen assembly, a lower screen assembly, and a central separator in accordance with a second embodiment of the invention.
Figure 6A:
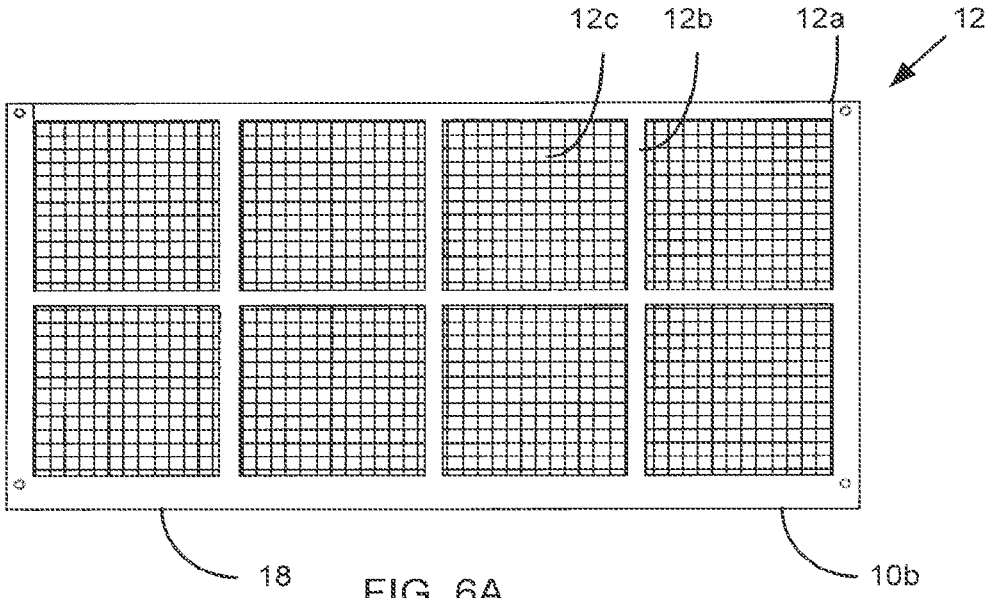
FIG. 6A is a top view of an upper screen assembly in accordance with one embodiment of the invention.
Figure 6B:
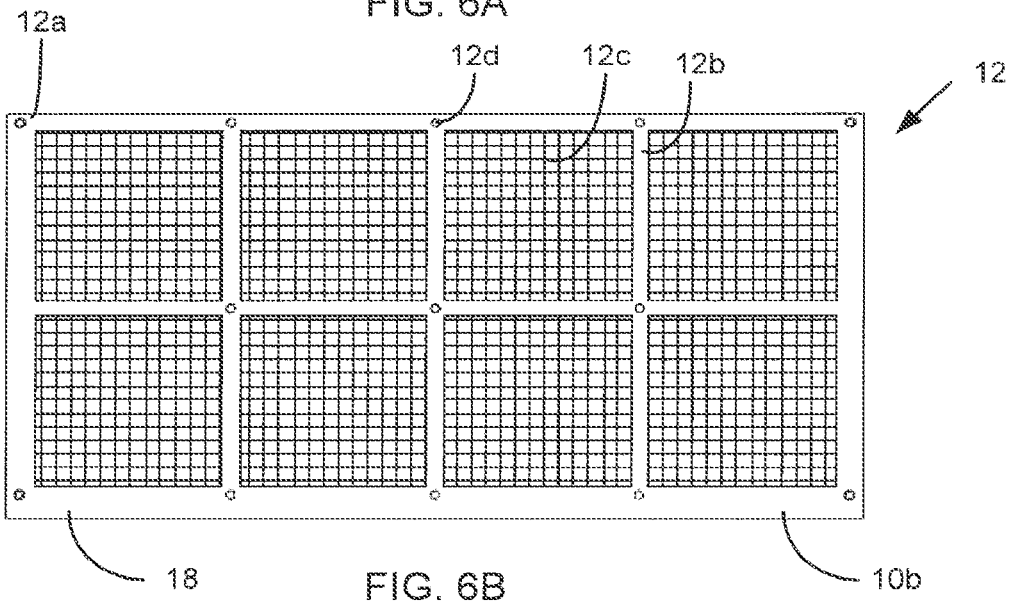
FIG. 6B is a bottom view of an upper screen assembly in accordance with one embodiment of the invention.
Figure 6C:
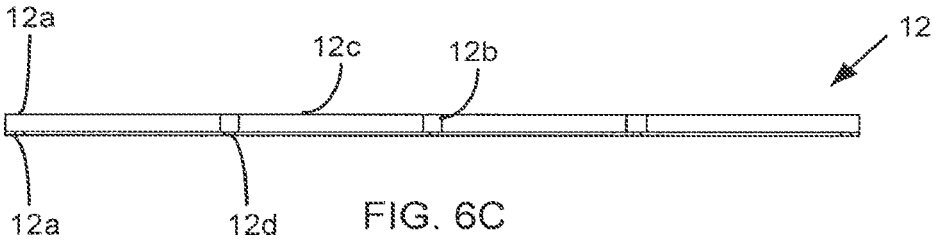
FIG. 6C is a front view of an upper screen assembly in accordance with one embodiment of the invention.
Figure 7A:
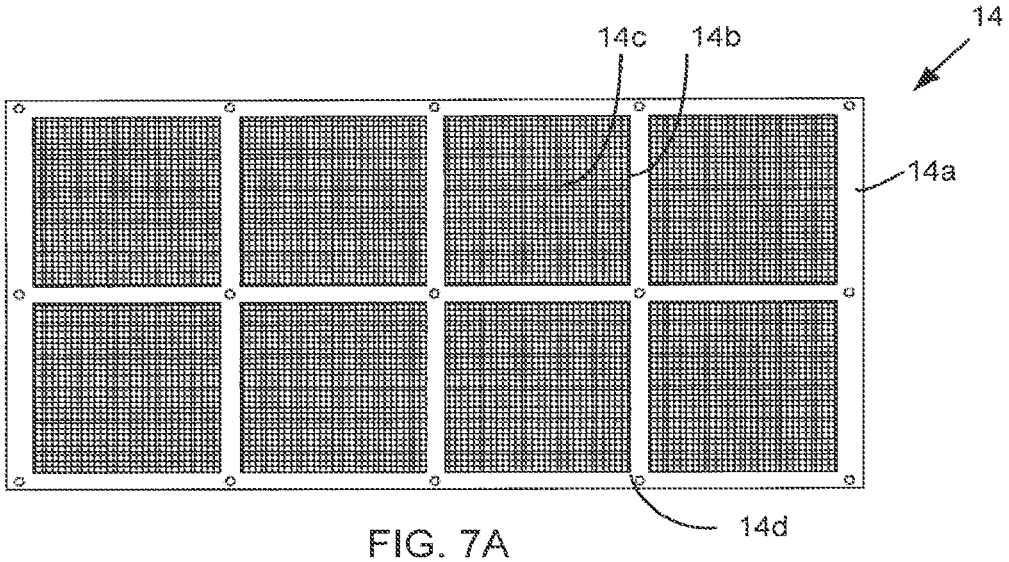
FIG. 7A is a top view of a lower screen assembly in accordance with one embodiment of the invention.
Figure 7B:
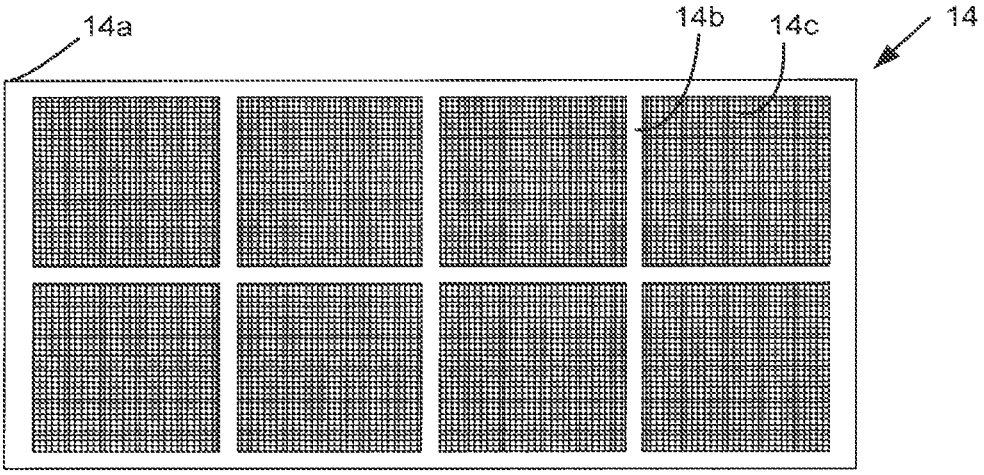
FIG. 7B is a bottom view of a lower screen assembly in accordance with one embodiment of the invention.
Figure 7C:
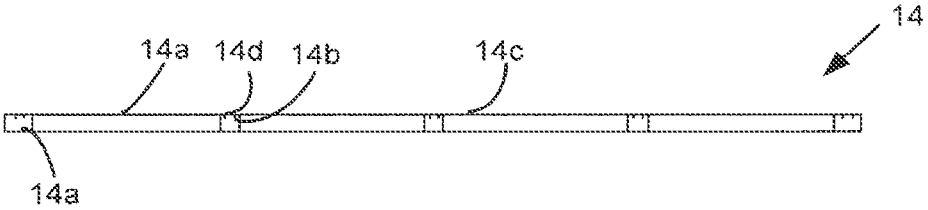
FIG. 7C is a front view of a lower screen assembly in accordance with one embodiment of the invention.
Figure 8A:
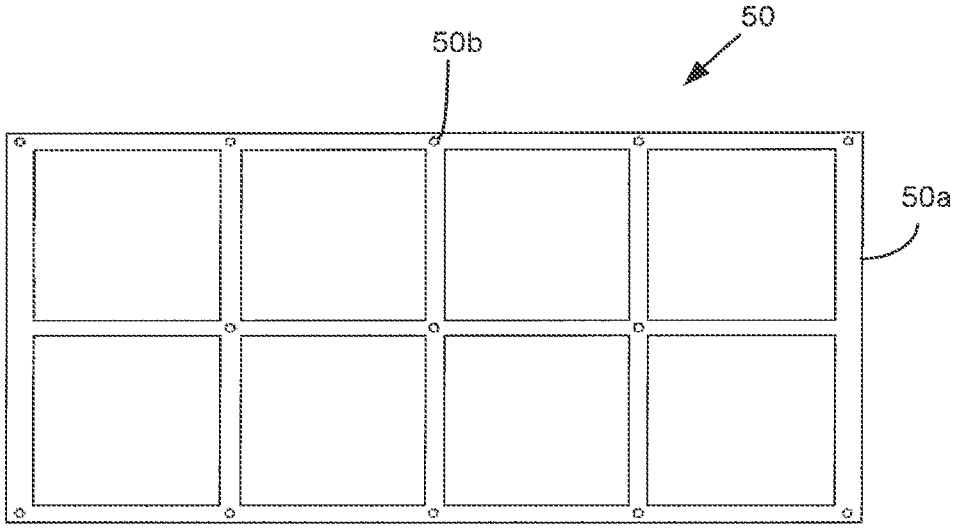
FIG. 8A is a top view of a central separator in accordance with the second and third embodiments of the invention.
Figure 8B:
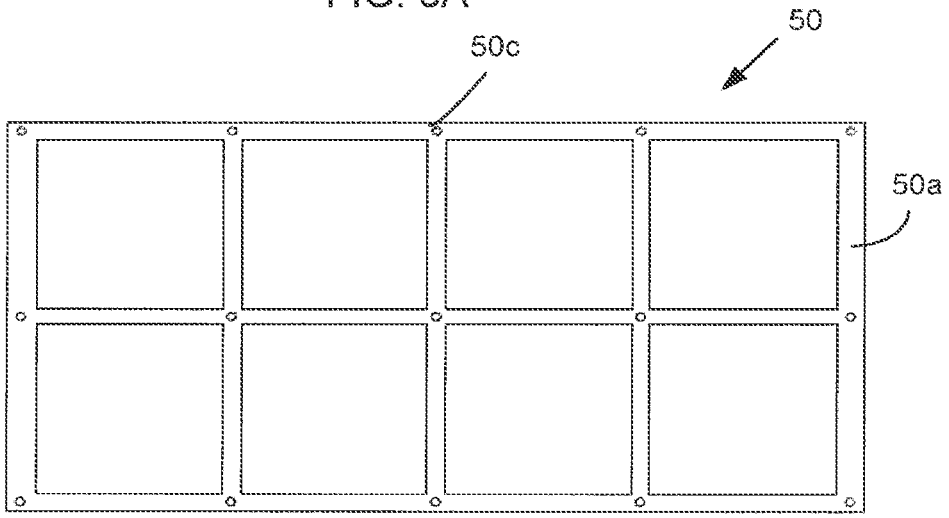
FIG. 8B is a bottom view of a central separator in accordance with the second and third embodiments of the invention.
Figure 8C:
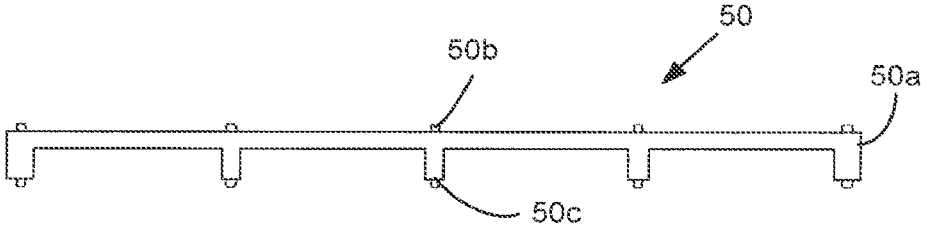
FIG. 8C is a front view of a central separator in accordance with the second and third embodiments of the invention.

FIG. 5A illustrates an alternate embodiment of the dual screen system 10 showing a front view of the upper screen assembly 12 and the lower screen assembly 14 connected by a central separator 50. FIGS. 6A, 6B and 6C further illustrate a top view, bottom view and front view, respectively, of the upper screen assembly 12 in this embodiment, while FIGS. 7A, 7B and 7C show a top view, bottom view and front view, respectively, of the lower screen assembly 14. FIGS. 8A, 8B and 8C further illustrate a top view, bottom view and front view, respectively, of the central separator 50. The central separator 50 connects the upper and lower screen assemblies and provides the channel 16 between the screens. The central separator 50 has a separator frame 50*a* and that aligns with and connects to the frames 12*a*, 14*a* and cross members 12*b*, and 14*b* of the upper and lower screen assemblies. Referring to FIGS. 8A, 8B and 8C, the separator has upper and lower pins 50*b*, 50*c* that align with and insert into corresponding holes 12*d*, 14*d*, on the upper screen bottom side (FIG. 6B) and the lower screen top side (FIG. 7A), respectively.

Alternate Embodiment of Upper Screen Having Lowered Wedge Guides

Figure 5B:
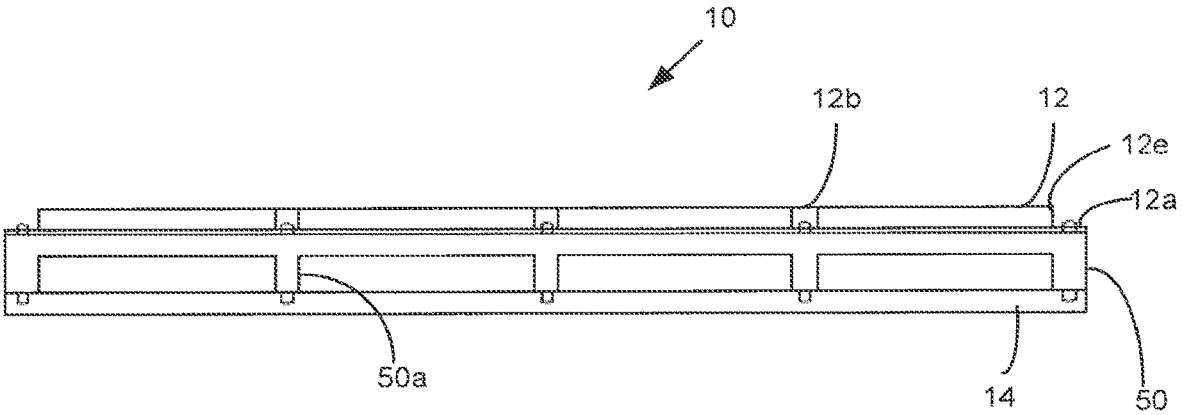
FIG. 5B is a front view of a dual screen system having an upper screen assembly with truncated edges, a lower screen assembly, and a central separator in accordance with a third embodiment of the invention. The truncated edges allow for a wedge or hydraulic/air pressure clamping mechanism to work while allowing for the upper screen to increase the gap beyond that could occur if the upper screen had a clamping surface equal in height to the top of the screen deck.

FIG. 5B illustrates an alternate embodiment of the dual screen system 10 wherein the lateral edges 12*e* on the top side of the upper screen frame 12*a* are inset with respect to the central separator 50 and lower screen frame 14*a*. This allows the dual screen system 10 to better fit into an existing shaker and align with wedge guides on the shaker, as discussed in further detail below.

Bar Connecting System for Dual Screen

Figure 5C:
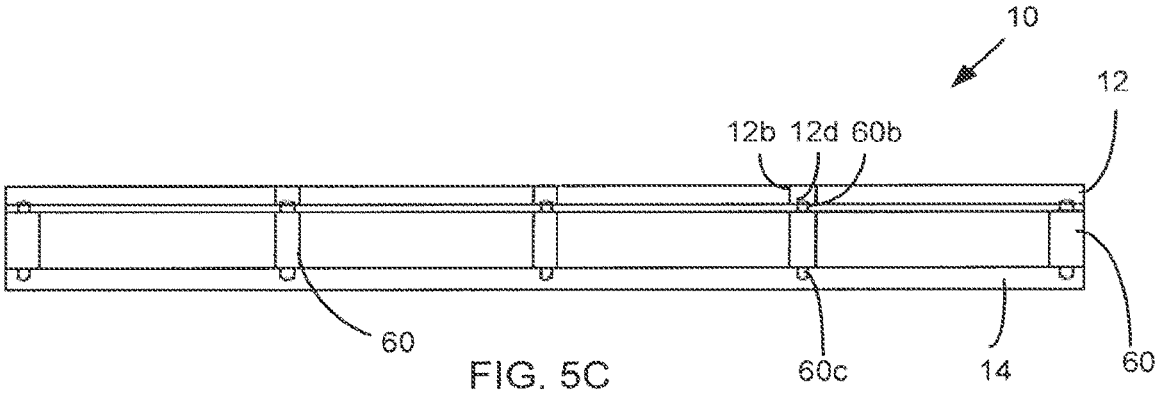
FIG. 5C is a front view of a dual screen system having an upper screen assembly, a lower screen assembly, and a bar connecting system in accordance with a fourth embodiment of the invention.
Figure 9A:
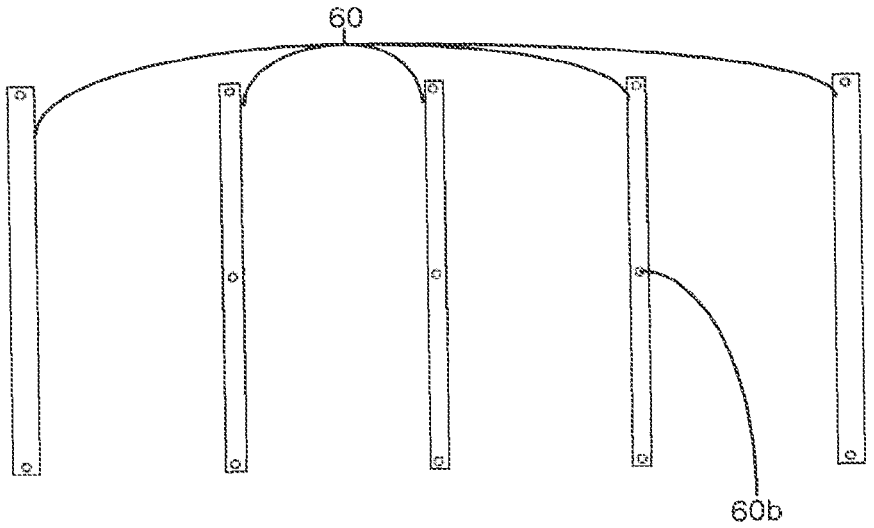
FIG. 9A is a top view of a bar connector system in accordance with the fourth embodiment of the invention.
Figure 9B:
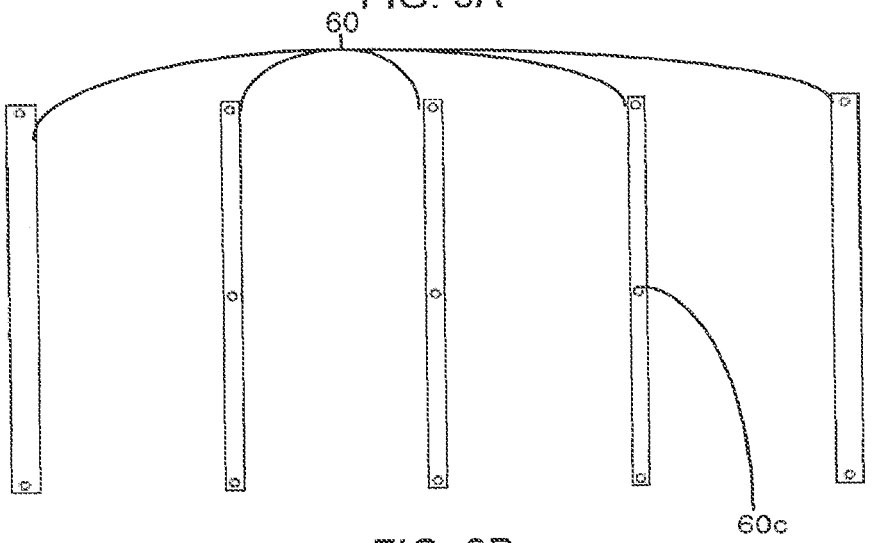
FIG. 9B is a bottom view of a bar connector system in accordance with the fourth embodiment of the invention.
Figure 9C:
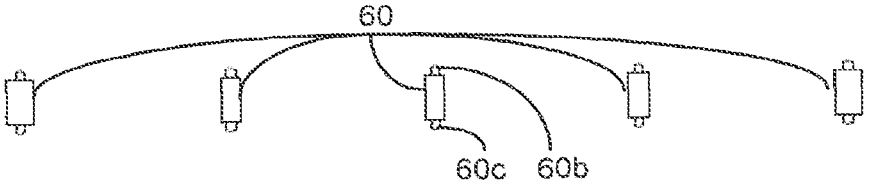
FIG. 9C is a front view of a bar connector system in accordance with the fourth embodiment of the invention.

FIG. 5C illustrates a side view of the dual screen system showing a further embodiment for connecting the upper screen assembly 12 and the lower screen assembly 14 using bar connectors 60. The bar connectors are further illustrated in FIGS. 9A, 9B and 9C, showing a top view, bottom view and front view, respectively. The bar connectors align with at least some of the cross members 12*b*, 14*b* and at least a portion of the screen frames 12*a*, 14*a*. Unlike the central separator 50 shown in FIGS. 8A, 8B and 8C, this connection method that uses bar connectors 60 does not have a separator frame. Instead, the bar connectors 60 are individually attached to the upper and lower screen cross members and frames to connect the two screens. Similar to the central separator system, the bar connectors have upper and lower pins 60*b*, 60*c* for alignment and connection to the holes 12*d*, 14*d* in the screen frames and cross members.

Figure 11:
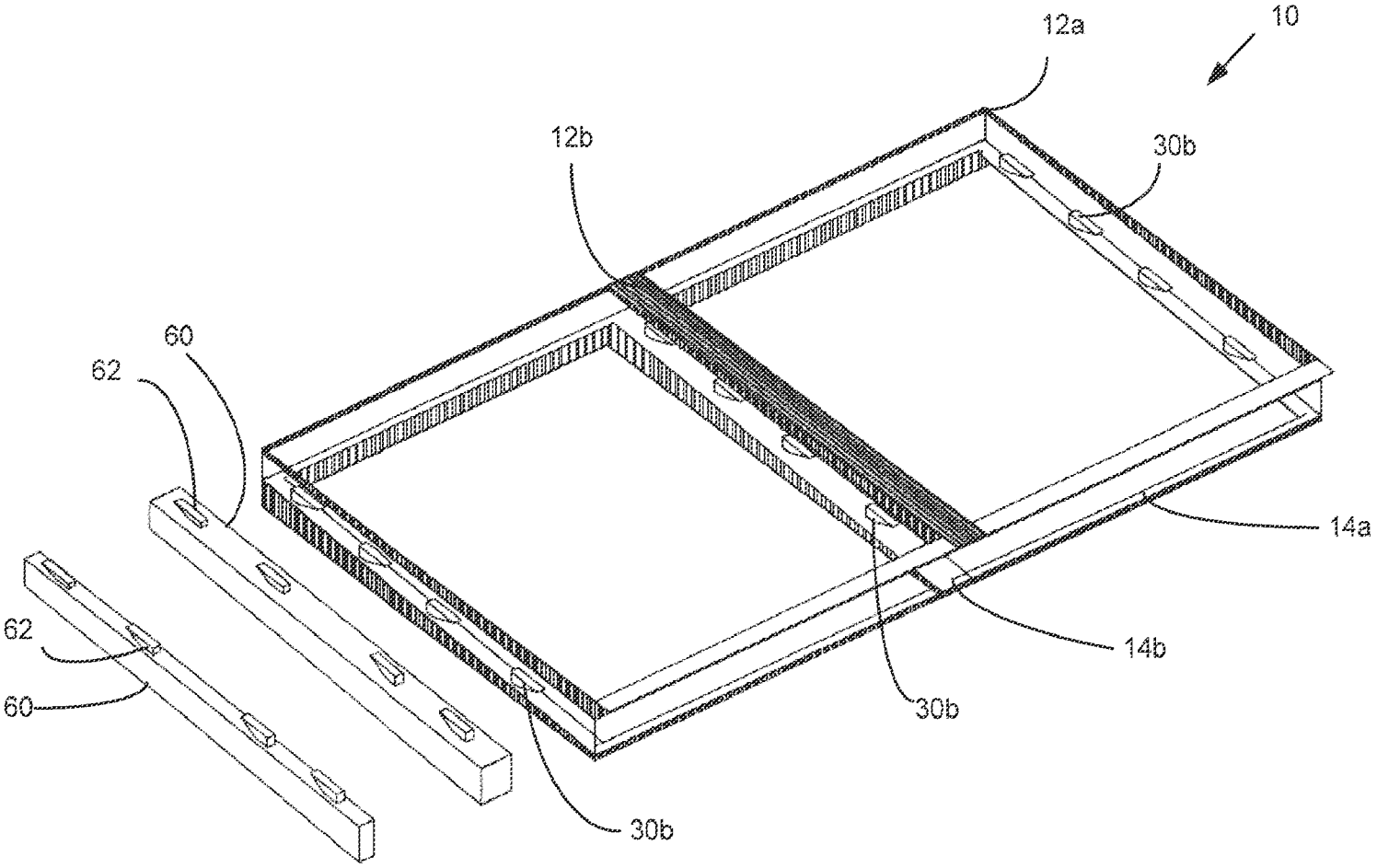
FIG. 11 is a front perspective view of a partially assembled dual screen system in accordance with one embodiment of the invention.

FIG. 10 shows a perspective view of the dual screen system connected by bar connectors 60. FIG. 11 shows an alternate embodiment of the dual screen system having bar connectors 60 with connecting members 62 that can operatively engage with the lower screen connecting members 30 and the upper screen connecting members (not shown).

To keep the upper and lower screen assemblies from sliding apart when they are composed of two pieces, a piece of rubber may be placed between the upper and lower screen assemblies, which in combination with pressure from the attachment system (e.g. a wedge or clamping attachment system), keeps the upper and lower screen in the proper orientation with respect to each other.

Other methods for connecting the upper and lower screen may be used as would be known to one skilled in the art, including bolting, welding, riveting, or gluing.

Retrofitting

The dual screen system 10 can be adapted to operate on existing shakers without any substantive modifications needed to the shaker. Certain shakers may require no modification, while other shakers may require repositioning the attachment system, such as the wedge guides, hydraulic equipment or hooks that fix the screen system in place in the shaker basket, and/or the addition of a blocking plate at the inbound end of the shaker to accommodate a taller screen system, as discussed below.

Figure 12:
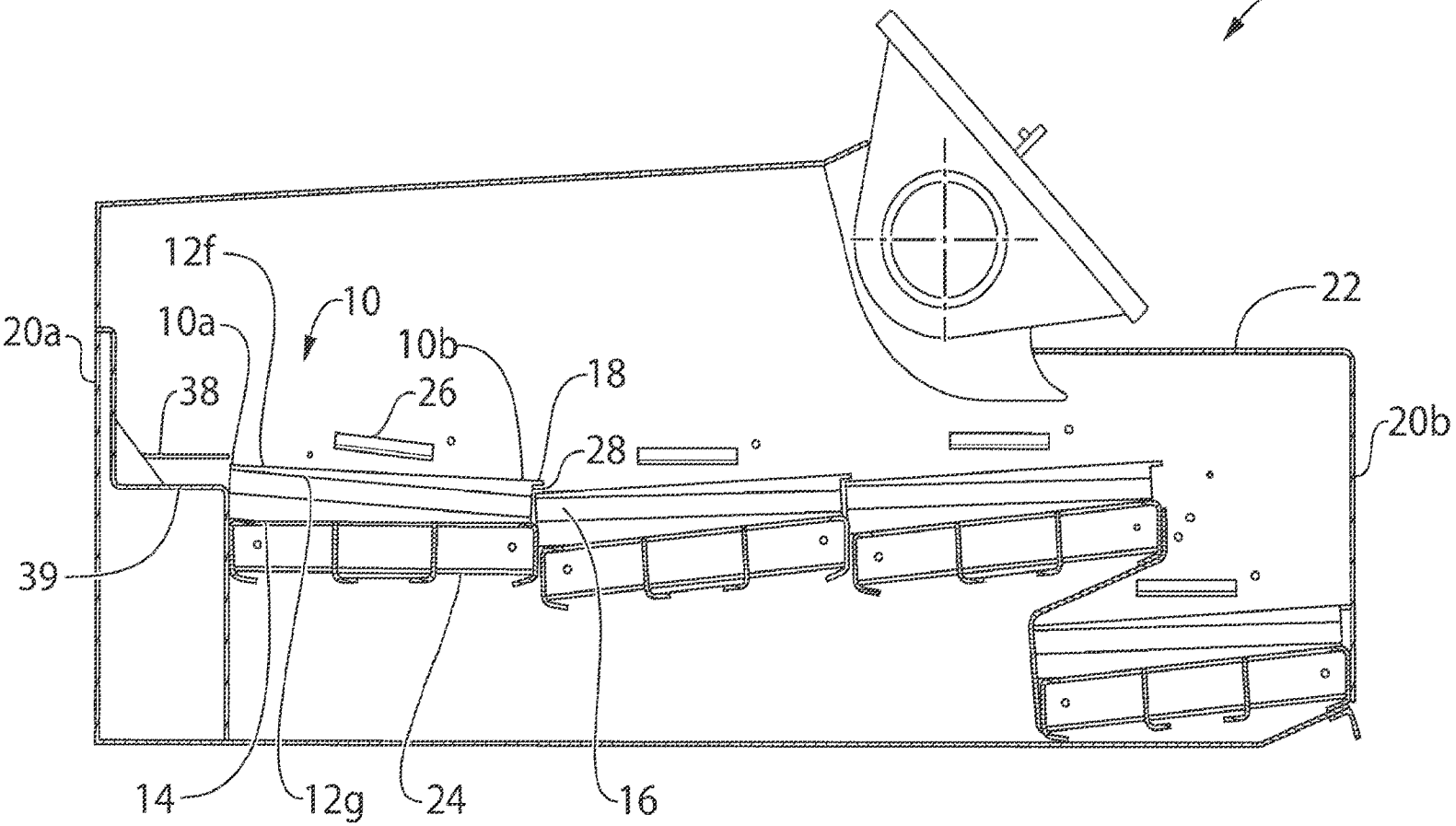
FIG. 12 is a side through view of a prior art shaker retrofit with four dual screen systems in accordance with one embodiment of the invention.

FIG. 12 illustrates a typical prior art shaker 20 having an inbound end 20*a* wherein a slurry of drill cuttings and drilling fluid enter the shaker, and an outbound end 20*b* wherein separated drill cuttings and drilling fluid exit the shaker. The shaker also includes a number of shaker beds 24, in this case four, designed to support single shaker screens in accordance with the prior art, and a shaker basket 27 for containing and imparting vibratory motion to the shaker beds and screens. The attachment system is illustrated as wedge guides 26 that secure the screens onto the shaker beds 24. When the slurry of cuttings enters the inbound end 20*a* of the shaker, they typically fall onto a contact plate 39 which absorbs the impact and directs the slurry onto the top of a first screen adjacent the inbound end of the shaker.

In accordance with the invention, the prior art shaker 20 is retrofit with a number of dual screen systems 10, each screen system having an intake end 10*a* and a discharge end 10*b* and connected to the shaker beds 24 with the wedge guides 26. In this embodiment, each upper screen assembly 12 includes a lip 18 at the discharge end to direct the flow of drill cuttings and drilling fluid from the discharge end onto a top surface 12*f* of the intake end of an adjacent upper screen assembly. The lip prevents the drill cuttings and drilling fluid from flowing into a gap 28 between the dual screen systems, or into the channel 16 between the upper screen assembly 12 and lower screen assembly 14. FIGS. 6A and 6B also illustrate the lip 18 on the upper screen 12.

If when the dual screen system 10 is installed in the existing shaker and the top surface 12*f* of a first upper screen 12*g* is located above the existing contact plate 39, a blocking plate 38 or similar apparatus is retrofit above the contact plate into the first screen assembly to prevent this in order to direct the flow of cuttings onto the upper screen top surface 12*f* in the first dual screen system. This ensures that coarse particles do not contact the first lower screen.

Figure 13:
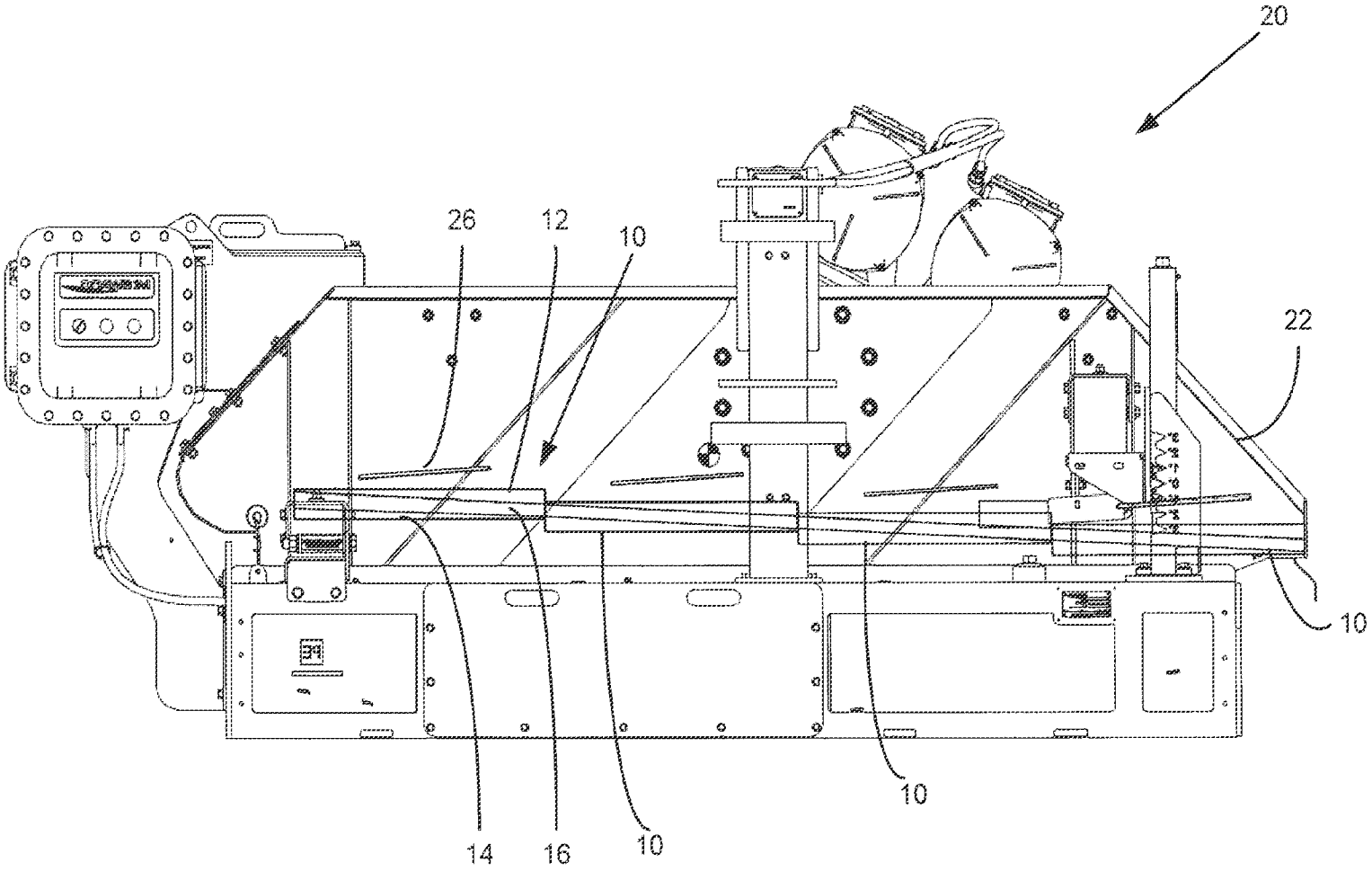
FIG. 13 is a side through view of a second prior art shaker retrofit with four dual screen systems in accordance with one embodiment of the invention.

A further embodiment of a prior art shaker 20 retrofit with the dual screen systems of the invention is illustrated in FIG. 13.

Advantages of a Dual Screen System

The dual screen system is preferably modular, allowing the upper and/or lower screen to be changed based on the properties of the slurry being processed in order to optimize the separation of drill cuttings from the drilling fluid. This allows an operator to select the optimal mesh size, screen material, configuration, and slope angle for both the upper and lower screen assembly. It also enables an operator to easily repair and/or replace components of the upper or lower screen assembly without having to replace the entire dual screen system if the screen assemblies are not permanently fixed into one piece. Importantly, this allows for only necessary screen components to be changed out due to uneven wear between the upper and lower screen assemblies on the dual screen system.

In the prior art, a series of shakers are often used to progressively separate drilling fluid from drill cuttings as the slurry proceeds through the series of shakers. By replacing a single screen in a shaker with the dual screen system in accordance with the invention, the dual screen system is able to process potentially double the volume of slurry in the same time with the substantially the same energy requirements as the single screen system. This reduces the number of shakers that are required and the associated time, costs, and space requirements. Thus, the dual screen system creates a more efficient and cost-effective system for separating drilling fluids and drill cuttings. In field trials the flow rate of a shaker which struggled to deal with a 0.5 $m^3$/min flow rate of drill cuttings/drill fluid when using a single 200 mesh API screen had a dual screen system installed with an upper screen using an 80 API screen and a lower screen using a 200 API screen, the dual screen system was able to process slurry flow rates in excess of 1.5 $m^3$/min.

Sloped Screen

Figure 14:
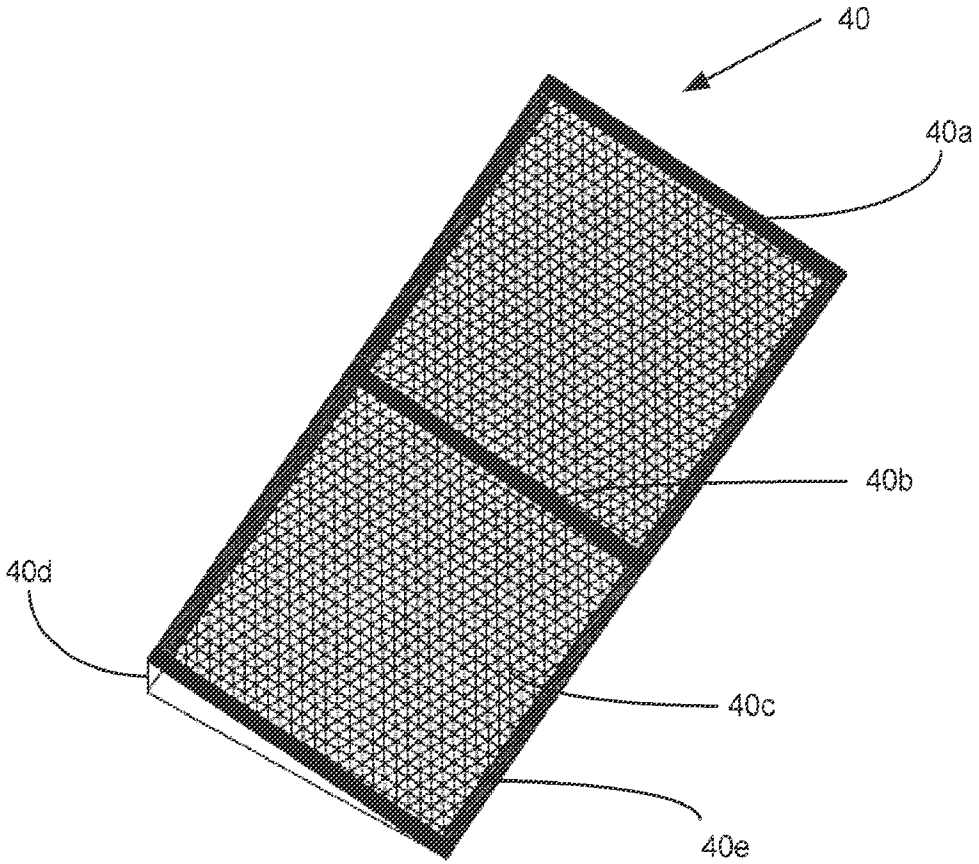
FIG. 14 is a top perspective view of a wedge-shaped screen assembly in accordance with one embodiment of the invention.

In one embodiment, the upper screen assembly or the lower screen assembly is sloped to create a "wedge-shaped" screen 40, shown in FIG. 14, to create an upward or downward sloping screen assembly in the shaker. Similar to the flat upper screen assembly 12 and lower screen assembly 14 shown in FIGS. 1, 2A and 3A, the wedge-shaped screen assembly 40 has a frame 40*a* with a cross member 40*b* and a screen mesh 40*c*, the difference being that the frame, cross member(s) and screen are sloped at an angle from the horizontal to create a thick end 40*d* and a tapered end 40*e*. Preferably, the angle of the screen is between −6 and +6 degrees.

In a further embodiment, both the upper screen and the lower screen assemblies are sloped. The screens may be sloped in the same direction or in opposite directions. The dual screen systems 10 installed in the shakers 20 shown in FIGS. 12 and 13 have wedge-shaped upper and lower screens, wherein the lower screens are downward sloping and the upper screens are upward sloping.

Advantages of a Sloped Screen

A wedge-shaped screen assembly changes the dynamics and the rate of flow of drilling fluid and drill cuttings across the screens. By sloping the screen at a downward angle, the rate of flow is increased, which is particularly useful when the slurry on the screen is viscous or sludge-like. Sloping the screen assembly upward decreases the rate of flow, allowing more time for a slurry to pass over a screen which may increase the separation of drilling fluid from drill cuttings. The slope angle and slope direction of the upper and lower screen assemblies can be independently modified based on the properties of the slurry to optimize the processing efficiency of the shaker. This design is for both single and dual screen applications and not been previously contemplated.

Figure 15A:
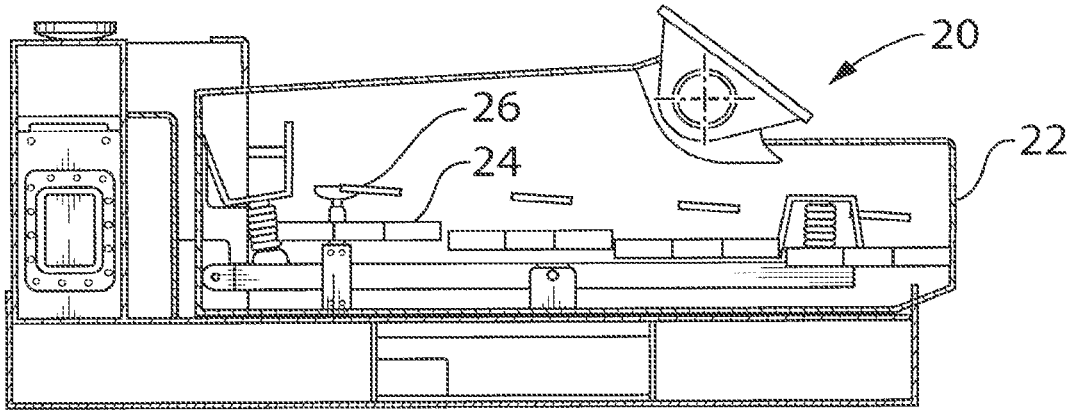
FIG. 15A is a schematic side view of a prior art shaker having a shaker bed in a neutral position, retro-fit with four flat dual screen systems in accordance with one embodiment of the invention.
Figure 15B:
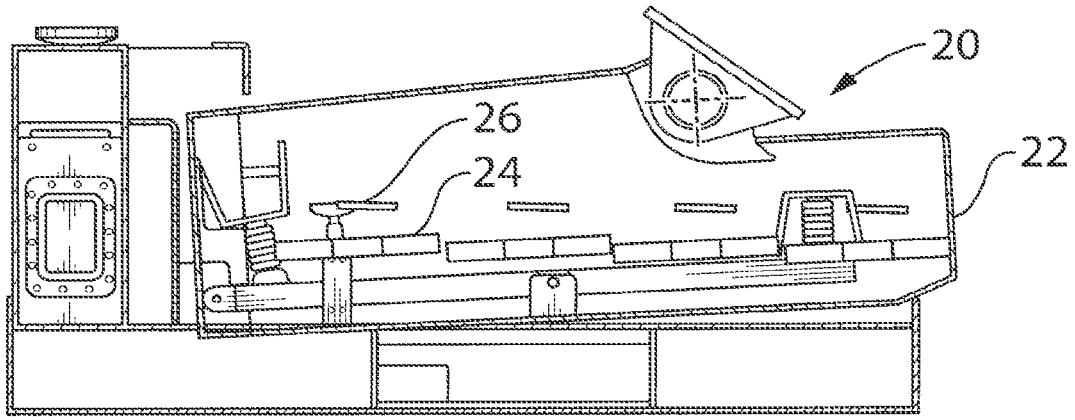
FIG. 15B is a schematic side view of a prior art shaker having a shaker bed in an upward tilt position, retro-fit with four flat dual screen systems in accordance with one embodiment of the invention.
Figure 15C:
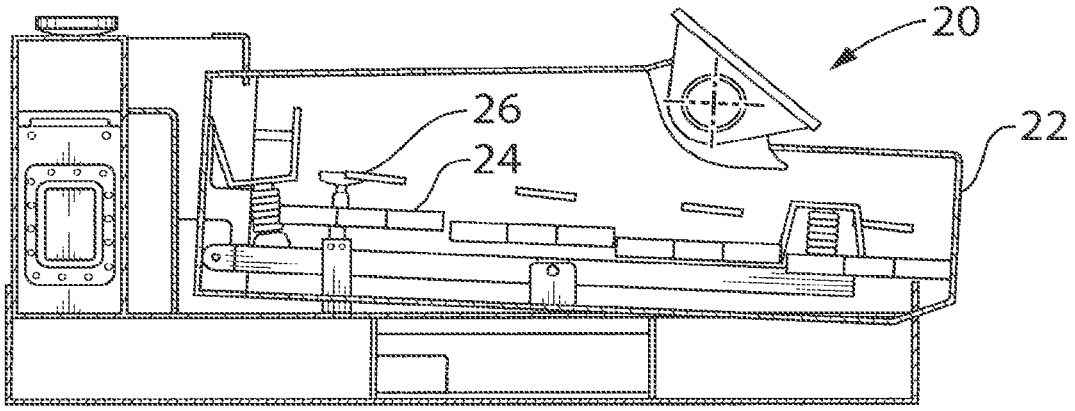
FIG. 15C is a schematic side view of a prior art shaker having a shaker bed in a downward tilt position, retro-fit with four flat dual screen systems in accordance with one embodiment of the invention.
Figure 16A:
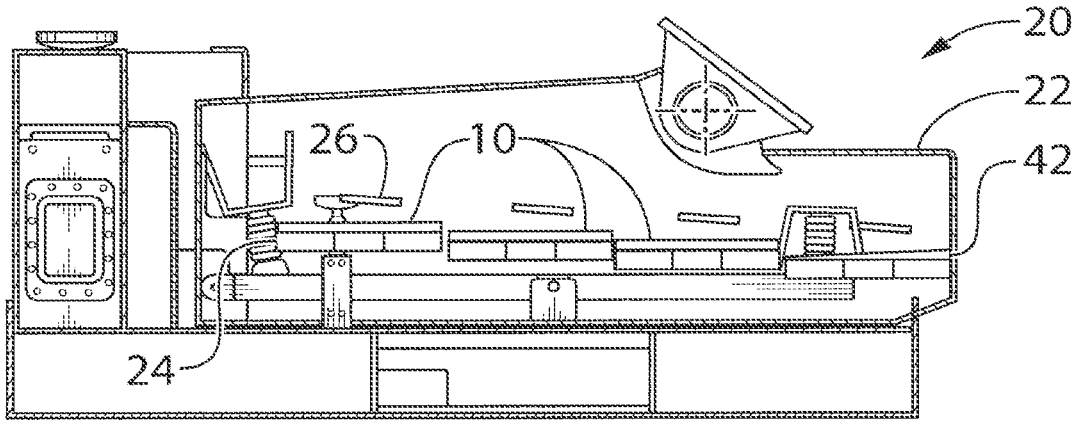
FIG. 16A is a schematic side view of a prior art shaker having a shaker bed in a neutral position, retro-fit with a combination of flat and wedge-shaped dual screen systems in accordance with one embodiment of the invention.
Figure 16B:
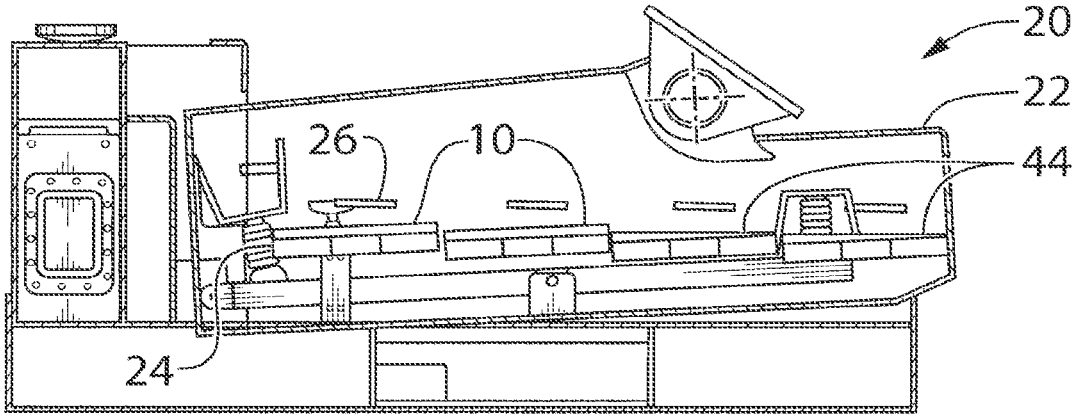
FIG. 16B is a schematic side view of a prior art shaker having a shaker bed in an upward tilt position, retro-fit with a combination of flat and wedge-shaped dual screen systems in accordance with one embodiment of the invention.
Figure 16C:
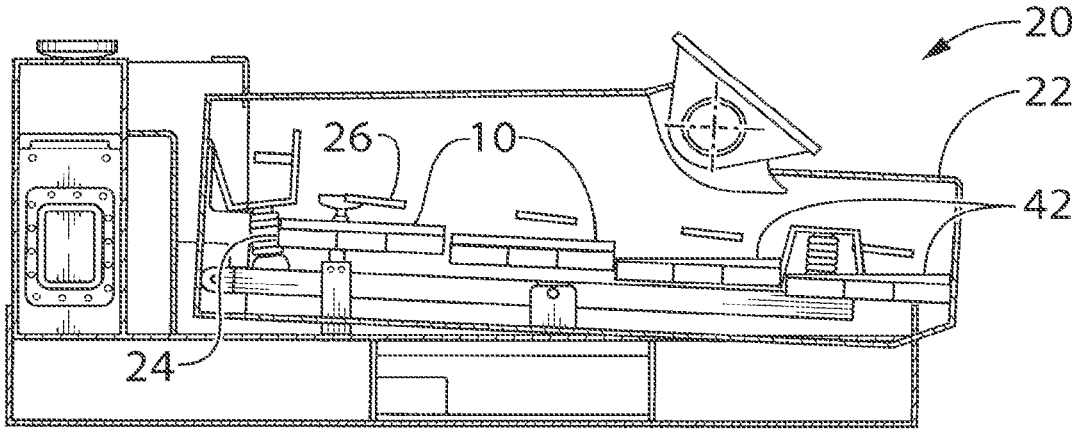
FIG. 16C a schematic side view of a prior art shaker having a shaker bed in a downward tilt position, retro-fit with a combination of flat and wedge-shaped dual screen systems in accordance with one embodiment of the invention.

In the prior art, there are shaker baskets that can be tilted in either an upward or downward direction to vary the rate of flow of the slurry across the shaker screens. By allowing for individual modification of individual shaker screens and angles, the rate of flow can be further individualized at different points across the shaker screens. Furthermore, modifying the angle of the shaker screens allows for the rate of flow to be adjusted in shakers lacking the ability to tilt the shaker basket. FIGS. 15A, 15B and 15C illustrate a prior art shaker 20 with a tiltable basket 22 containing four shaker beds 24. FIG. 15A illustrates the basket in a neutral position; FIG. 15B illustrates the basket in an upward tilt position; and FIG. 15C illustrates the basket in a downward tilt position. As can be seen, tilting the basket tilts all the shaker beds 24 at the same angle as the shaker bed, and the system is not capable of individual modification of each shaker bed. In contrast, and in accordance with a further embodiment of the in invention, the same shakers 20 having the basket 22 in either the neutral (FIG. 16A), upward tilt (FIG. 16B) or downward tilt (FIG. 16C) position are retrofit with a combination of flat dual screen systems 10 and either upward tilting wedge-shaped dual screens 42 or downward tilting wedge-shaped dual screens 44 to further individualize the flow rate of the slurry across the shaker screens.

Figure 17:
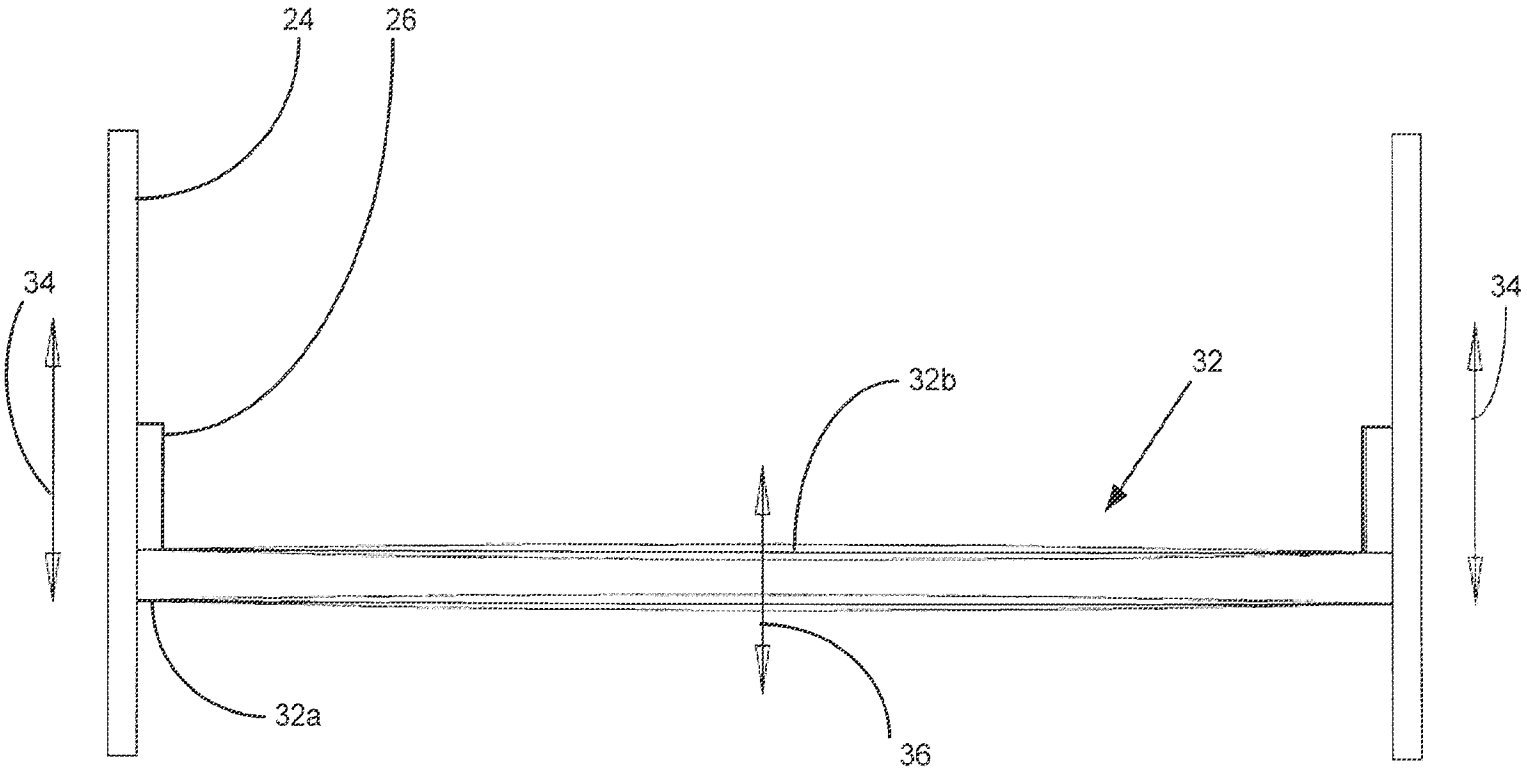
FIG. 17 is a front view of vibrating shaker bed and shaker screen showing the vibration harmonics of the screen edges compared to the screen center in accordance with one embodiment of the invention.

In prior art vibratory shaker screens 32, as illustrated in FIG. 17, the edges 32*a* of the screen assembly are held in place on the shaker bed 24 by an attachment system 26, which may include wedges, hydraulic clamps or tensioning hooks, while the center 32*b* of the screen is not directly compressed onto the shaker bed but depends on edge pressure and its own rigidity to maintain contact in the center of the bed. When the shaker bed and attachment system vibrate at a given frequency and amplitude, represented by arrow 34, the screen edges typically vibrate at the same frequency and amplitude, whereas the center of the screen, being further away from the attachment system, typically vibrates at a lower frequency and amplitude represented by arrow 36. This often causes drill cuttings in the center of the screen to swirl on the screen instead of moving in a relatively straight line off of the screen, creating greater wear in the center of the screen compared to the screen edges. When the center of the screen is worn, the whole screen needs to be replaced, even though the screen edges may still have life left in them. By using a wedge shaped screen, the harmonics of the vibrations are affected since the center of the screen is narrower than the back of the screen, and the swirl effect in the center of the screen is reduced, lengthening the life of the screen.

Screen Support System

Figure 18:
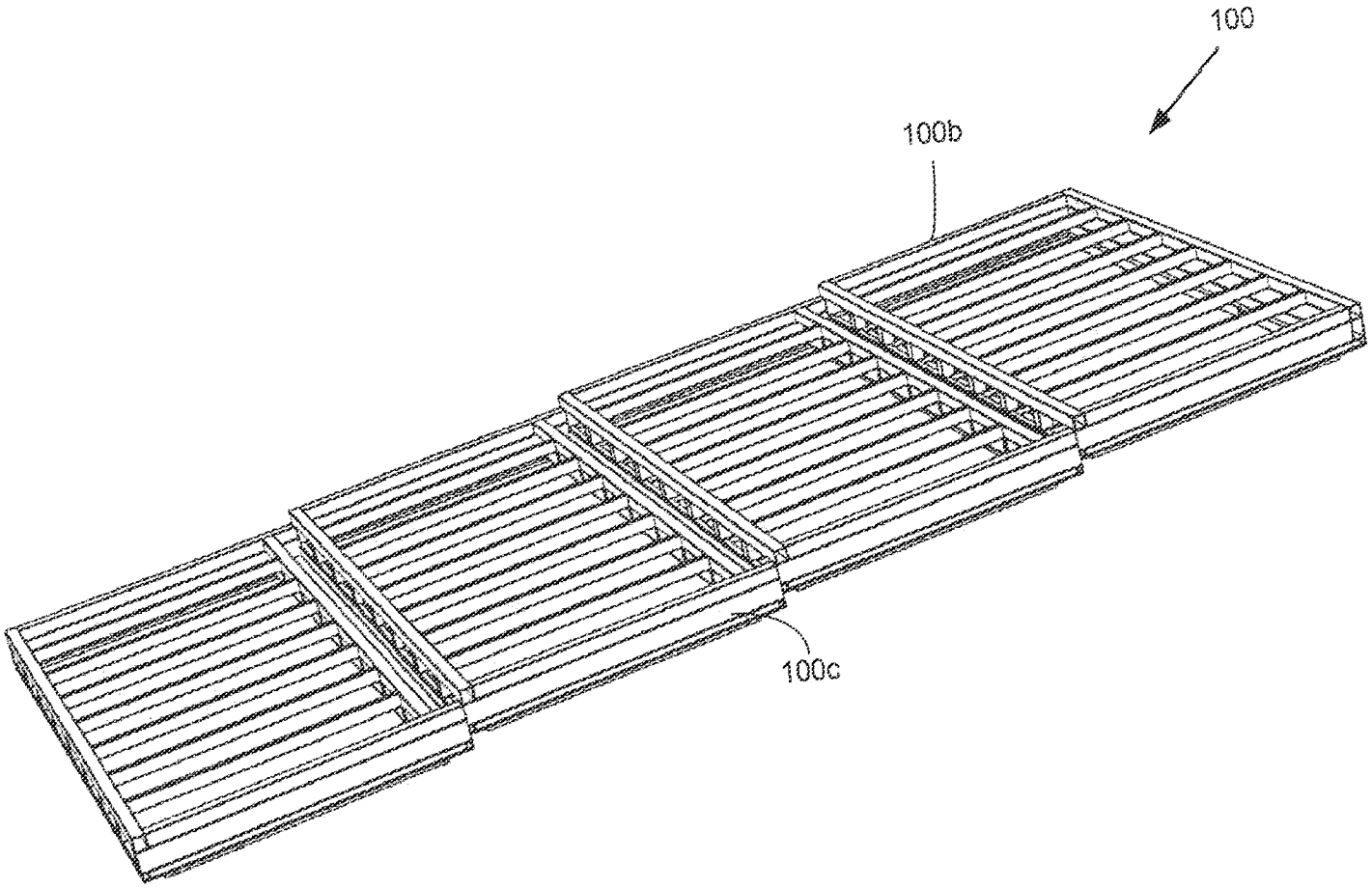
FIG. 18 is a perspective view of a screen support system for retro-fit use in a stepped shaker in accordance with one embodiment of the invention.
Figure 18A:
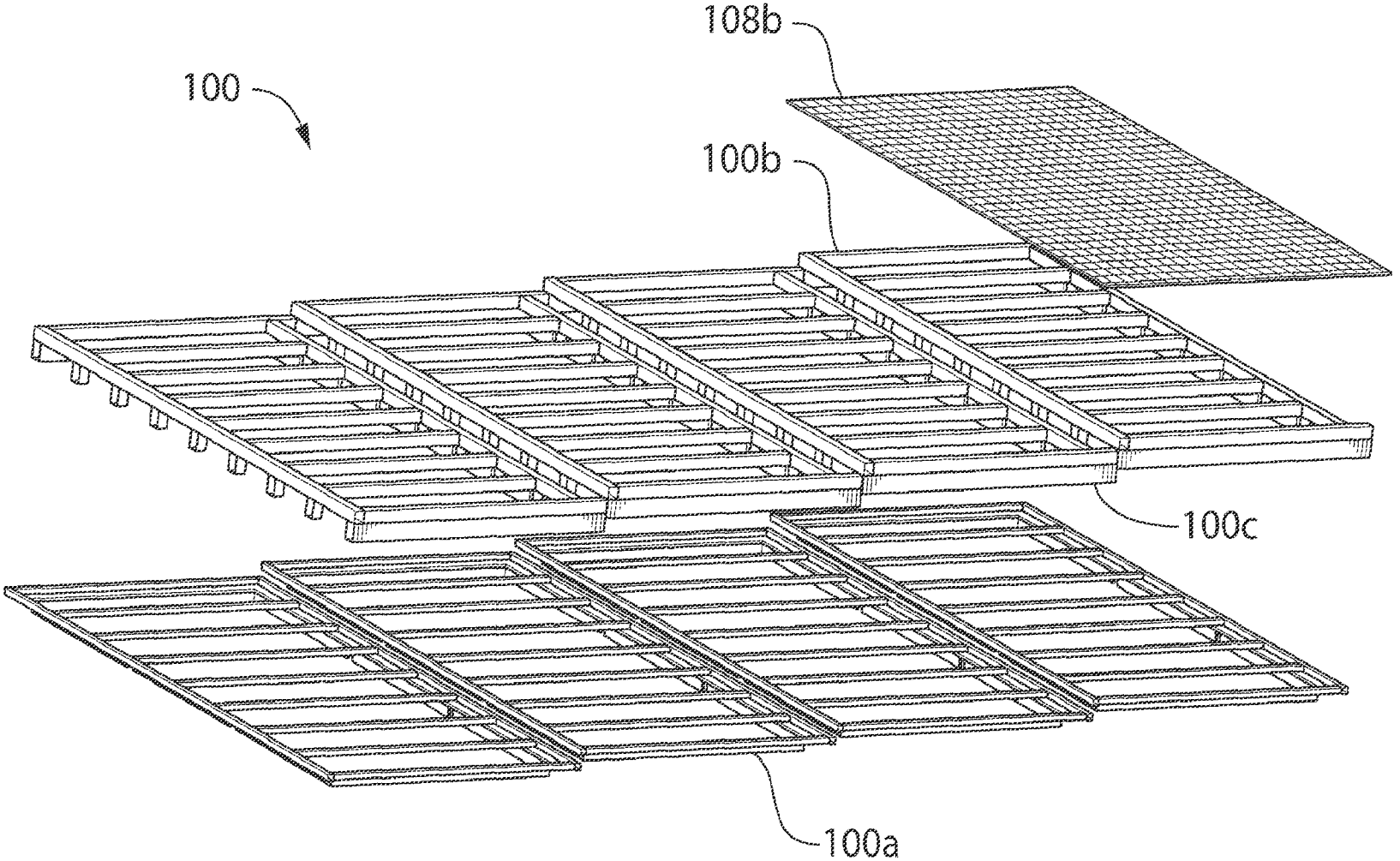
FIG. 18A is an exploded view of a screen support system for retro-fit use in a stepped shaker showing a lower screen support system, upper screen support system and a screen in accordance with one embodiment of the invention.
Figure 18B:
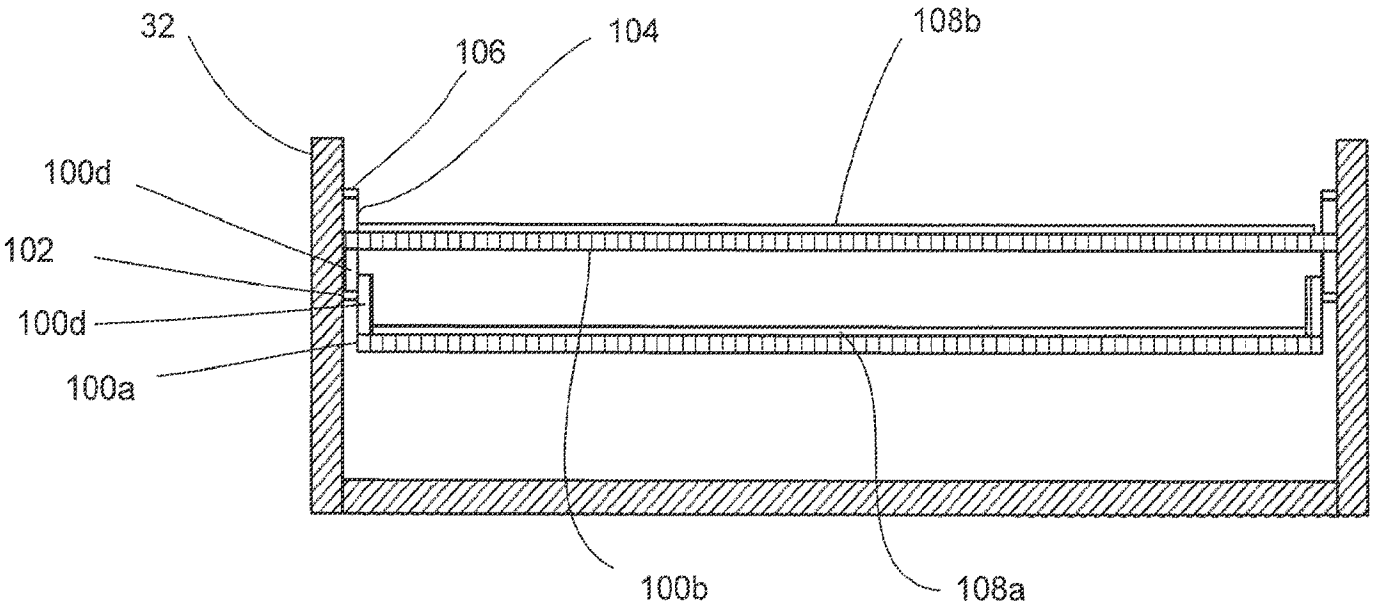
FIG. 18B is a schematic cross-sectional view of a dual screen support system with the lower screen support lower than existing screen support brackets in accordance with one embodiment of the invention.

FIG. 18B is a cross-sectional view of a screen support system 100 within a shaker basket 22. As shown in FIG. 18B, each screen is supported by screen support brackets 102 on either side of the shaker basket and are typically held in place by wedges 104. A wedge 104 will typically be secured between the flat upper surface of the screen and an angle bracket 106 protruding from the side of the shaker basket above the screen support brackets. Accordingly, by driving the wedges into the space beneath the angle brackets and the screen, the screens can be secured in place.

In order to effectively retrofit a dual screen support system 100 to an existing shaker utilizing the existing wedge system, it is preferred that the upper screen does not completely fill the wedge space such that similar wedges (or at least narrower wedges) can used. Accordingly, as shown in FIG. 18B, it is preferred that the lower screen support system 100*a* is lower with respect to the screen support brackets 102. However the use of angle iron or an equivalent on the side of the upper screen as shown in FIG. 5B can compensate for this.

As shown, the lower screen support system 100*a* has a narrower width relative to the width of the shaker basket 22 that enables the upper surface of the lower screen support system 100*a* and lower screen 108 to be lower than the screen support brackets 102. Support legs 100*c*, 100*d* are configured to provide the vertical separation distance between the lower screen 108*a* and the upper screen 108*b* and a seat to support the system on the screen support brackets 102. For the purposes of clarity, other midsection support legs that may be incorporated are omitted from FIG. 18B.

In various embodiments, a screen support system is welded, bolted or glued together to support two layers of screens and may be assembled as a one piece frame.

As shown in FIG. 18A, an upper screen 108*b* is configured to an upper screen support 100*b*. Similar screens are configured to the entire upper frame surfaces and to the lower frame surfaces.

Dual Screen for Use in a Stepped or Cascading Screen Shaker

As described above, some shaker systems provide a stepped configuration within the shaker basket such that drill cuttings step downwardly as they progress across the individual screens of the shaker bed. The dual screen system of the invention can be utilized in such stepped or cascading screen shakers. As shown in FIGS. 18 and 18A, a dual screen support system 100 for use in a stepped shaker can comprise a series of individual support systems that are vertically offset with regards to one another. FIG. 18 shows an assembled dual screen support system and FIG. 18A shows a partially exploded dual screen support system.

Figure 18C:
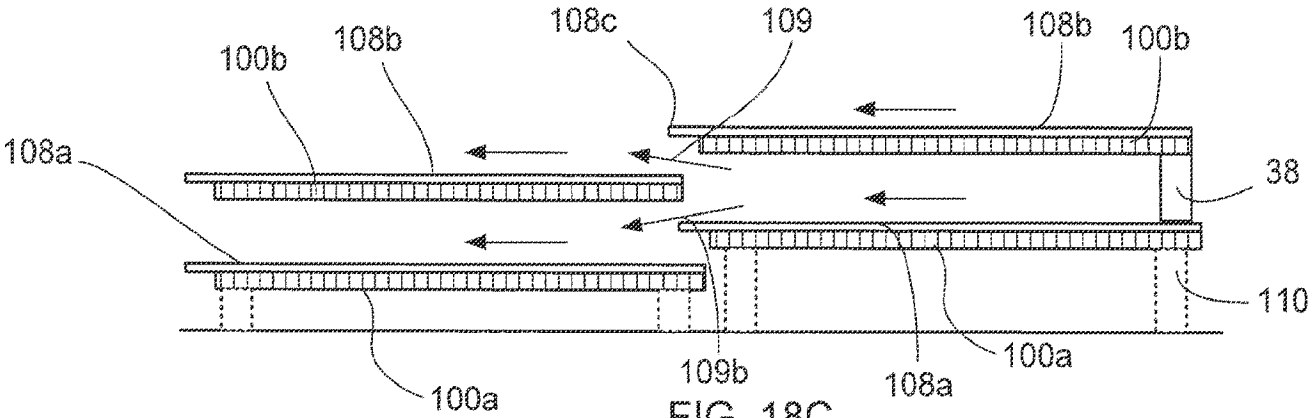
FIG. 18C is a schematic cross-sectional view of two adjacent screens in a stepped screen system showing the possible flow of material from a lower screen to an upper screen in accordance with one embodiment of the invention.

FIG. 18C shows how the flow of drill cuttings and drilling fluid may progress over a series of stepped frames. Importantly, upper and lower screens 108*a*, 108*b* will include an extension 108*c* that extends beyond the edge of support frame 100*a*, 100*b* to ensure that drill cuttings/drill fluid flow onto the next screen. In addition, it is preferred that a first gap 109 exists between an upper screen support 100*b* and a downstream upper screen 108*b* such that if the volume of drilling fluid/drill cuttings on a lower screen 108*a* is high, such volume of material can flow from the lower screen area onto a downstream screen through the first gap 109.

Figure 18D:
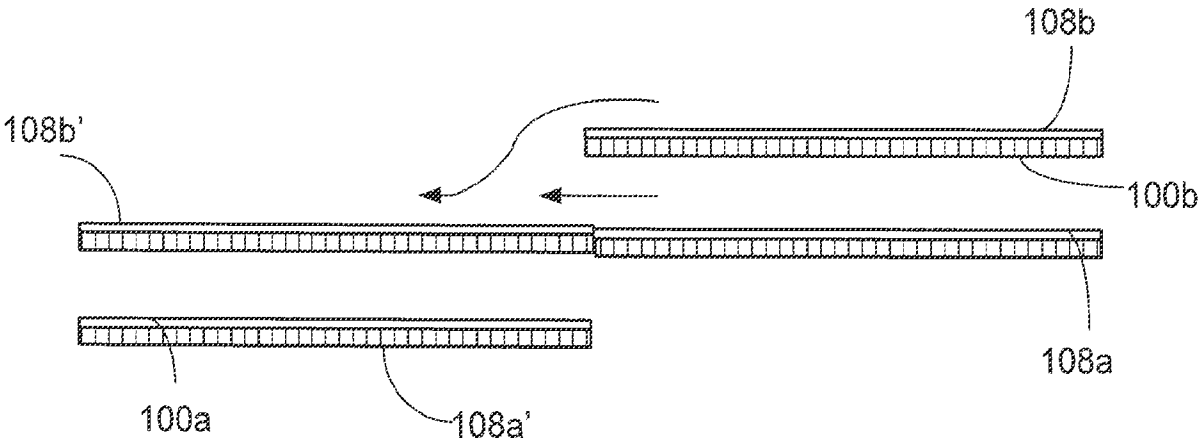
FIG. 18D is a schematic cross-sectional view of two adjacent dual screen assemblies in a stepped screen system showing the possible flow of material from a lower screen only to an upper screen in accordance with one embodiment of the invention.
Figure 18E:
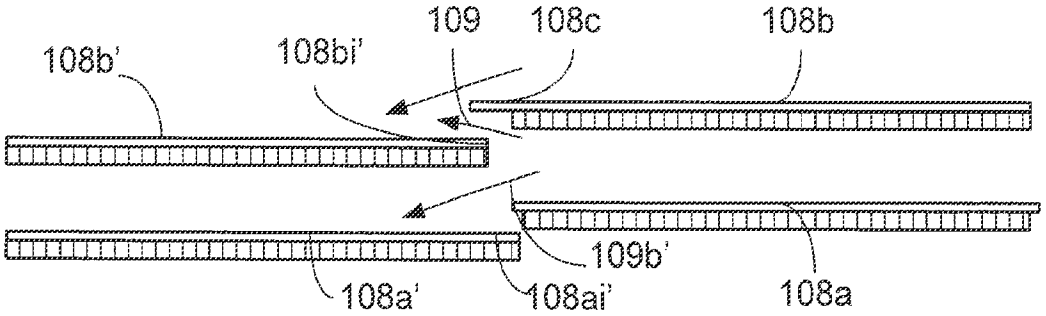
FIG. 18E is a schematic cross-sectional view of two adjacent dual screen assemblies in a stepped screen system wherein the downstream upper screen is inset with respect to the downstream lower screen in accordance with one embodiment of the invention.

In another embodiment shown in FIG. 18E, a second gap or channel 109*b*' located between the upstream and downstream lower screens 108*a*, 108*a*' may be enlarged by having an upstream end 108*bi*' of the downstream upper screen 108*b*' inset with respect to an upstream end 108*ai*' of the downstream lower screen 108*a*'. The extension 108*c* on the upstream upper screen 108*b* ensures that drill cuttings/drilling fluid from the upstream upper screen 108*b* flows onto the downstream upper screen 108*b*' instead of onto the downstream lower screen 108*a*'. This embodiment allows for less of a height difference between the upstream and downstream stepped screens, while still allowing efficient flow between the upstream and downstream screens. Less of a height difference means the upper screen has a lower profile, allowing the dual screen system to better fit into an existing shaker bed attachment system. For example, if the attachment system is a wedge clamping system, the lower profile allows for larger wedges to be used to hold the dual screen system in place. As shown in FIG. 18E, there is still the first gap 109 between the upstream and downstream upper screens 108*b*, 108*b*' to allow excessive buildup of drill cuttings/drilling fluid on the upstream lower screen 108*a* to flow onto the downstream upper screen 108*b*' in case there is insufficient space to flow onto the downstream lower screen 108*a*'.

Alternatively, as shown in FIG. 18D, the stepped screens may be positioned such that drill cuttings/drill fluid from the upstream lower and upper screens 108*a*, 108*b* flow only onto the downstream upper screen 108*b*' and are prevented from flowing directly onto the downstream lower screen 108*a*'.

Importantly, by placing coarser and hence stronger screens on the upper surfaces, the finer screens on the lower surfaces will be protected from larger drill cuttings and hence, the life of the finer screens will be enhanced.

It should be noted that more than two screen support systems may be incorporated if space considerations enable such a configuration.

Dual Shaker Screens for Flat Screen Bed Shakers

In a still further embodiment, the dual screen systems may be retrofit to a shaker having a flat non-cascading screen bed to create a dual screen system having a cascading effect between adjacent screens. In this case, the upstream dual screen system would be elevated above the normal screen bed level and each subsequent downstream dual screen system positioned at a lower level such that drill cuttings can step down. In this case, additional support members 110 would be included as shown schematically in FIG. 18 such that each dual screen system was positioned at a different height. In this case, a shaker having a flat screen bed can be retrofit to enable cuttings to flow through a created gap 109 as described above. Further still, the upper screen may angled upwards at about 1°-3° in the direction of flow. This ensures that on a flat or cascade decks that the discharge end of the leading upper screen is above the intake side of the trailing screen.

Alternatively, the dual screen system can be used in a flat screen bed shaker without positioning the dual screens in a cascading manner. The prior art shaker would typically have a single screen running from the upstream end of the shaker to the downstream end of the shaker, and there can be one screen bed or multiple screen beds, arranged as parallel decks on top of one another or in another configuration. The dual screen system of the invention could be used in such a shaker by replacing the one or more single screens with one or more dual screens that extend along the entire screen bed. In this embodiment, there would not be a gap between adjacent upper screen sections, or adjacent lower screen sections, since each upper screen would be substantially continuous, as would each lower screen.

In another embodiment, the screen bed may be curved instead of flat, such as in a convex manner. Furthermore, the dual screen system may include one or more three-dimensional screens, such as a pyramidal screen. Such a screen may be used to increase the surface area of the screen.

Alternative Embodiments for Attachment Systems

As discussed in the background, single screens of the prior art are attached to shaker systems using various attachment systems, which may include wedge clamping systems, air or hydraulic pressure plate clamping systems, and hook screen tensioning systems. Shaker systems having any of these attachment systems can be retrofit to accommodate the dual screen system of the present invention, including dual screen systems made of a single structure (i.e. a one-piece dual screen system) or of multiple structures (i.e.

a two-piece dual screen system). An example of a dual screen system of the present invention held in place with a wedge clamping system is shown in FIG. 18B, as discussed above.

Figure 19A:
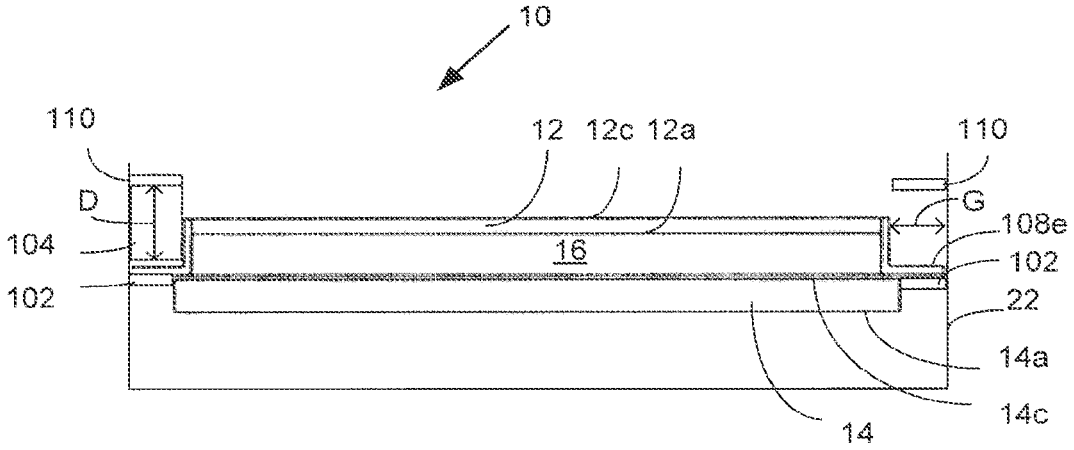
FIG. 19A is an end view of a dual screen support system adapted for use in a shaker bed having a wedge clamping attachment system in accordance with one embodiment of the invention.

FIG. 19A is an end view of another embodiment of the dual screen system 10 having a channel 16 between the upper screen assembly 12 and lower screen assembly 14, wherein the dual screen system is adapted for attachment in an existing shaker basket 22 having a wedge clamping attachment system. A screen support bracket 102 is located on each side of the shaker basket to support an attachment arm 108*e* that extends from each side of the dual screen system. The attachment arm may comprise one or more arms connected to one or both of the lower and upper screen frame 12*a*, 14*a*. On the left side of the dual screen system in FIG. 19A, the wedge 104 is shown holding the dual screen support system in place between the screen support bracket 102 and an upper bracket 110 which is typically attached to the shaker basket. On the right side, no wedge is present, which allows the dual screen system to be inserted or removed from the shaker basket. The upper screen assembly may be narrower in width than the shaker basket, such that it does not extend to the edges of the shaker basket, which creates a gap G between the edge of the upper screen assembly and the shaker basket wall, allowing a wedge of height H to secure the dual screen system, height H being the same size as would be used to secure a conventional single screen system in the same shaker basket.

Figure 19B:
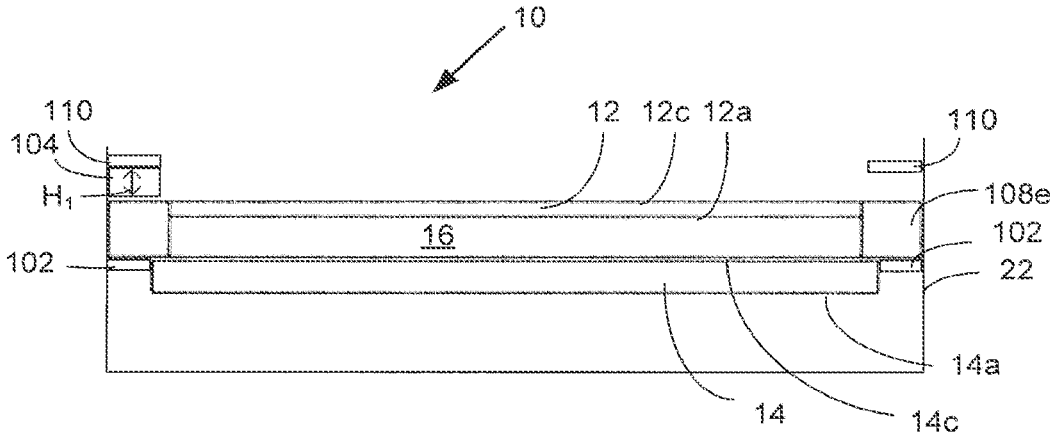
FIG. 19B is an end view of a dual screen support system adapted for use in a shaker bed having a wedge clamping attachment system in accordance with one embodiment of the invention.

Alternatively, FIG. 19B illustrates a dual screen system 10 wherein the upper screen assembly 12 extends to the edge of the shaker basket wall. Accordingly, a shorter wedge having height HT would be needed to secure the dual screen system in the shaker basket if the screen support bracket 102 and upper bracket 110 are not moved.

Figure 20:
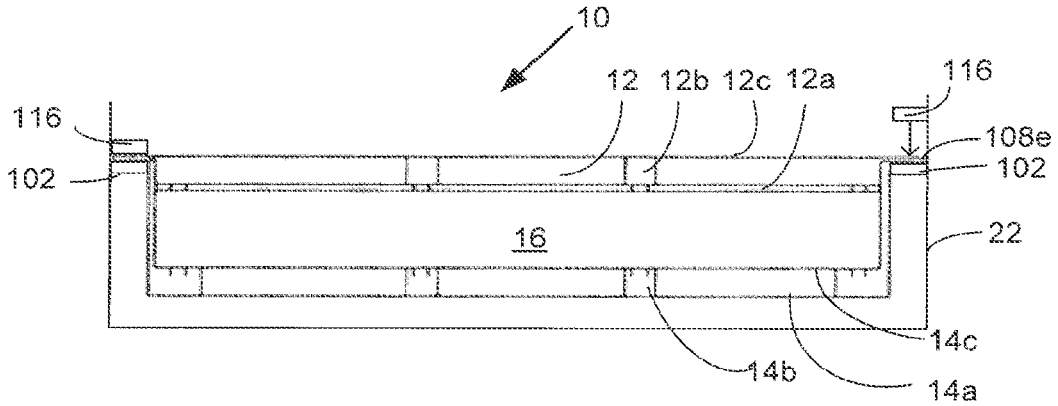
FIG. 20 is an end view of a dual screen support system adapted for use in a shaker bed having an air pressure or hydraulic clamping system in accordance with one embodiment of the invention.

FIG. 20 illustrates a dual screen system 10 adapted for use in a shaker basket 22 having a hydraulic or air pressure clamping system. The clamping system includes a piston 116 at each end of the shaker basket 22 that moves downward to clamp the attachment arm 108*e* of the dual screen system 10 between the piston and the screen support bracket 102. On the left side of FIG. 20, the piston is shown in the clamped position, holding the dual screen system in place, while on the right side, the piston is in the open position, which is used to insert or remove the dual screen system. Various support members 12*b*, 14*b* of the upper and lower screens are illustrated.

Figure 21:
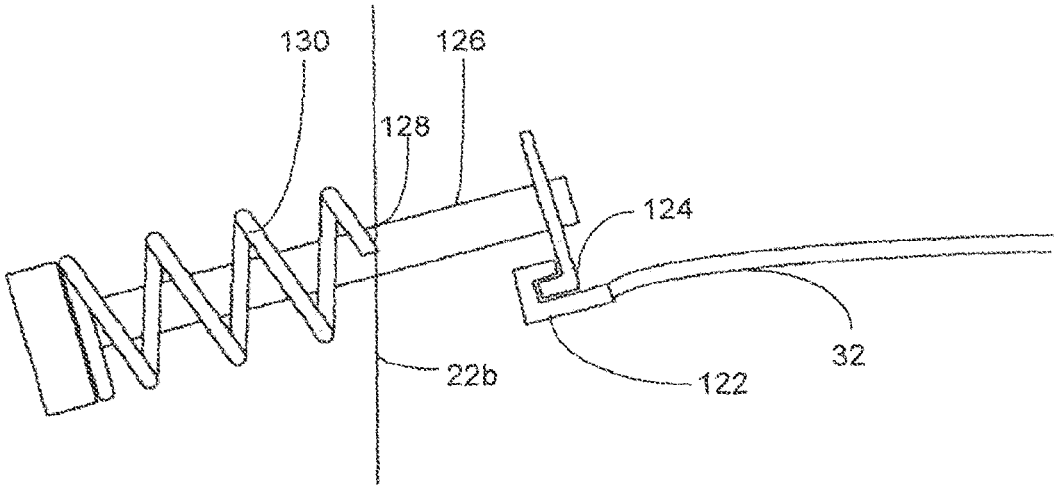
FIG. 21 is an end view of a hook screen attachment system for attaching a single screen to a shaker bed in accordance with the prior art.

FIG. 21 illustrates a hook screen system of the prior art for attaching and tensioning a single screen 32. At each side of the shaker basket, the hook screen system includes a hook 124 attached to a lever 126 that extends through a hole 128 in the shaker basket wall 22*b*. The hook attaches to a corresponding screen hook 122 at the end of the screen, allowing the screen to be pulled tight to secure the screen in place in the basket and provide tension on the screen. FIG. 21 illustrates a spring system 130 for tensioning the hook screen attachment system. However as known to one skilled in the art, other types of systems can be used to apply a force to the lever, such as a bolt and screw arrangement or an air pressure or hydraulic piston assembly.

Figure 22:
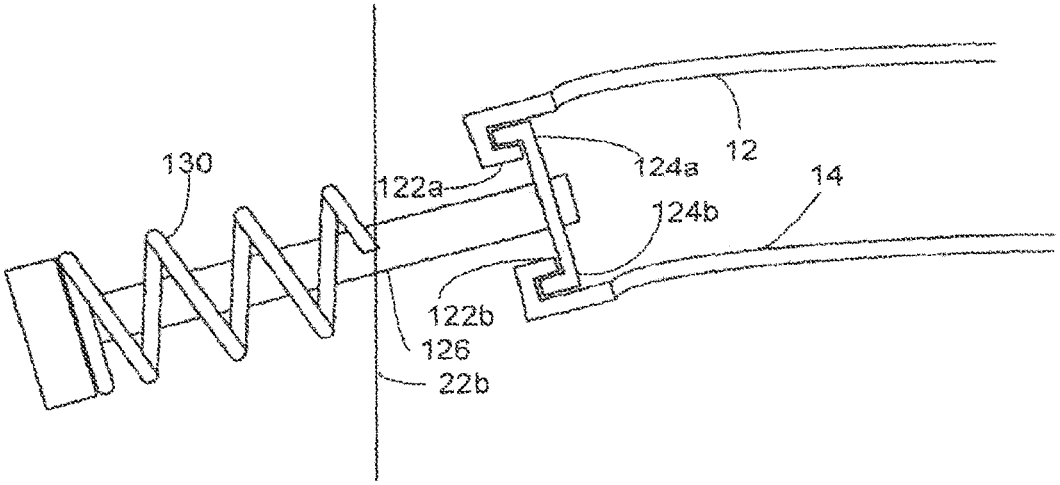
FIG. 22 is an end view of a dual screen support system adapted for use in a shaker bed having a hook screen attachment system in accordance with one embodiment of the invention.

The hook screen attachment system of the prior art can be adapted for securing the dual screen system 10 of the invention in a shaker basket. One embodiment of doing so is shown in FIG. 22, wherein the hook 124 is provided with both an upper and lower hook 124*a*, 124*b*, which is configured to connect to corresponding hooks 122*a*, 122*b* on the upper screen assembly 12 and lower screen assembly 14, respectively. In this embodiment, the upper hook 124*a* and corresponding hook 122*s* are flipped upside down, i.e. reversed in orientation, compared to the lower hook 124*b* and corresponding hook 122*b*. Alternatively, the upper hook and lower hook could have the same orientation in order for the same corresponding hook 122*a*, 122*b* to be used on the upper and lower screen assemblies. Furthermore, the prior art hook system could be retained and a second hook system could be installed in the shaker basket above the existing hook system for attaching and tensioning the upper screen assembly.

Testing Results

Testing was conducted to determine the difference in the cuttings fluid retention factor of a single screen of the prior art versus a dual screen in accordance with the invention using the same shaker and the same drilling fluid/cuttings mixture. The testing was conducted in accordance with industry standards. The results show that the single screen had a cuttings retention factor (measured in $m^3$ mud/$m^3$ cuttings) of 0.894, while the dual screen had a lower cuttings retention factor of 0.818. During the testing, the single screen was tilted against the direction of fluid/cuttings flow at a +2 setting on a shaker, whereas the dual screen was tilted with the direction of flow at −1. This difference in screen angle would actually benefit the single screen system for separating drill cuttings from drilling fluid, since the cuttings/fluid would be retained on the single screen for a longer period of time based on the tilt against the direction of flow compared to the dual screen system.

Although the present invention has been described and illustrated with respect to preferred embodiments and preferred uses thereof, it is not to be so limited since modifications and changes can be made therein which are within the full, intended scope of the invention as understood by those skilled in the art.

What is claimed is:

1. A dual screen system for retro-fit connection to a shaker, the dual screen system comprising:

a lower screen support for supporting a first lower screen;

an upper screen support, the upper screen support for supporting a first upper screen above the first lower screen;

wherein the lower screen support and upper screen support define a dual screen support pair;

wherein the dual screen system includes a dual screen support pair for each step within the shaker; and wherein each adjacent dual screen support pair are offset with respect to one another and maintain first and second gaps between each adjacent dual screen support pair enabling drill fluid/drill cuttings to flow from an upstream lower screen to an adjacent downstream lower screen and when flow is high to flow from an upstream lower screen to an adjacent downstream upper screen.

2. The dual screen system of claim 1, wherein adjacent dual screen support pairs are attached together.

3. The dual screen system of claim 1, further comprising screen surfaces affixed to each of the lower screen support and upper screen support for each dual screen support pair.

4. The dual screen system of claim 3, wherein each screen surface includes a downstream lip having dimensions to overlap an upstream edge of an adjacent downstream screen.

5. The dual screen system of claim 1, where a coarse screen is attached to each upper screen support and a fine screen is attached to each lower screen support.

* * * * *